US009926125B2

(12) United States Patent
Whitehurst

(10) Patent No.: US 9,926,125 B2
(45) Date of Patent: Mar. 27, 2018

(54) LATCHABLE PACKAGE

(71) Applicant: Duff Design Limited, London (GB)

(72) Inventor: Dane Whitehurst, London (GB)

(73) Assignee: Duff Design Limited, London (GB)

( * ) Notice: Subject to any disclaimer, the term of this patent is extended or adjusted under 35 U.S.C. 154(b) by 0 days.

(21) Appl. No.: 15/345,735

(22) Filed: Nov. 8, 2016

(65) Prior Publication Data

US 2017/0217658 A1 Aug. 3, 2017

(30) Foreign Application Priority Data

Jan. 28, 2016 (GB) ..... 1601626.3
Nov. 7, 2016 (GB) ..... 1618766.8

(51) Int. Cl.
*B65D 5/38* (2006.01)
*B65D 79/00* (2006.01)
*B65D 59/04* (2006.01)

(52) U.S. Cl.
CPC ..... *B65D 79/00* (2013.01); *B65D 5/38* (2013.01); *B65D 59/04* (2013.01); *B65D 2215/02* (2013.01); *B65D 2215/06* (2013.01); *B65D 2583/0468* (2013.01)

(58) Field of Classification Search
CPC ..... B65D 5/38; B65D 59/04
USPC ..... 206/468, 528
See application file for complete search history.

(56) References Cited

U.S. PATENT DOCUMENTS 8,499,936 B2 * 8/2013 Albrecht ..... B65D 83/0463 206/528
2002/0056652 A1 5/2002 Kawamura et al.
2011/0011765 A1 * 1/2011 Gelardi ..... B65D 50/067 206/531

FOREIGN PATENT DOCUMENTS

WO 2005102849 A1 11/2005
WO 2009024772 A2 2/2009

OTHER PUBLICATIONS

Combined Search and Examination Report, dated Mar. 7, 2016 pertaining to UK patent application serial No. GB1601626.3 filed Jan. 28, 2016.

* cited by examiner

*Primary Examiner* — King M Chu
(74) *Attorney, Agent, or Firm* — Dinsmore & Shohl LLP

(57) ABSTRACT

A latchable package comprises: a support for supporting one or more items; a structure for selectively blocking access to the one or more items; and a latchable insert. The latchable insert comprises a substantially planar tab member that is coupled to the support such that the insert and support are movable together in an opening direction from a first position in which the structure blocks access to the one or more items to a second position in which the one or more items are accessibly clear of the structure. The structure and the latchable insert comprise co-operating latch features configured to engage when the insert and support are arranged in the first position.

24 Claims, 22 Drawing Sheets

LATCHABLE PACKAGE

CROSS REFERENCE TO RELATED APPLICATIONS

This application claims priority from UK Patent Application No. GB1618766.8, filed Nov. 7, 2016, and UK Patent Application No. GB1601626.3, filed Jan. 28, 2016, the disclosures of which are incorporated herein by reference.

BACKGROUND OF THE INVENTION

This invention relates to a latchable package such as a box, which may be used in the packaging of items. In particular, though not exclusively, the invention relates to a child-resistant package for storing potentially hazardous materials such as, for example, pharmaceuticals, which must be kept safe from children or irresponsible adults.

The safe storage of potentially hazardous materials such as pharmaceuticals has long been a problem for families with young children. Whilst parents desire access to a wide range of pharmaceuticals in order to be able to treat illnesses promptly and easily, the natural curiosity of children can cause them to seek out and ingest such materials when unsupervised. This can have serious consequences. For example, an overdose of virtually any pharmaceutical is injurious to health. Indeed some pharmaceuticals are entirely unsuitable for children and have an adverse effect on the health of children even if handled or ingested in very small quantities.

For the sake of simplicity, potentially hazardous materials such as those described above will hereinafter simply be referred to as "hazardous materials". Additionally, the problems described above are not limited to children and can also arise in respect of irresponsible or forgetful adults, such as for example some mentally ill or mentally disabled patients, or the elderly who may be prone to confusion as to the contents of a package. Whilst the focus of this specification is on children, it will be appreciated that the majority of what is described herein applies analogously to irresponsible or forgetful adults. All such analogies are within the scope of this specification, even where reference is made only to children.

In light of their dangerous nature, hazardous materials must be kept out of the reach of children. This is an established practice that is of fundamental importance and which may be augmented, but can never be replaced, by child resistant closures (CRCs). CRCs make it harder for children to extract hazardous materials from a package, if they do manage gain access to them in packaged form.

Many CRC designs have been suggested in the past. However, such CRC designs are often complicated in structure and expensive to manufacture. In particular, assembly processes are typically longer and more complex for child-resistant packages, which results in a costlier manufacturing process. Since the cost of packaging is generally passed on to consumers, this leads consumers to buy products in non-resistant packaging where available, thereby increasing the risk of accidental poisonings and the like. Minimising complexity of a CRC design and its manufacturing process, and hence minimising its cost, is therefore crucial in providing a successful CRC.

It is important to balance the child-resistance of a CRC with reasonable ease of opening for adults wishing to access the contents of the package. For example, adults needing to take medication housed in the package may be physically impaired. Current CRC designs often require two-handed operation as an inherent part of their child resistance. However, this two-handed design can be inconvenient for users, for example if users have dexterity in only one hand, or if users need to open a CRC whilst using one hand for another task.

A further design consideration is that once a CRC has been opened, it is important that it can be easily and perceptibly returned to a secured position. If the mechanism for returning the CRC to a secured position is too complicated, the user may omit to return the CRC to the secured position, thereby leaving the hazardous material more easily accessible. If it is not obvious to the user that the CRC has been returned to the secured position, the user may inadvertently fail to secure the package correctly before it is returned to its storage place, negating the child-resistant design.

It is an object of this invention to address at least one of the problems described above.

STATEMENTS OF THE INVENTION

Against this background, from a first aspect, the invention resides in a latchable package comprising: a support for supporting one or more items a structure for selectively blocking access to the one or more items; and a latchable insert. The latchable insert comprises a substantially planar tab member that is coupled to the support such that the insert and support are movable together in an opening direction from a first position in which the structure blocks access to the one or more items to a second position in which the one or more items are accessibly clear of the structure. The structure and the latchable insert comprise co-operating latch features configured to engage when the insert and support are arranged in the first position.

The latchable insert provides a simple means for conferring a latchable functionality on a package. The latchable insert can be easily coupled to the support, and the package is therefore easy and hence inexpensive to manufacture. The resulting package is therefore relatively inexpensive. Furthermore, because the latchable functionality is provided by a substantially planar tab member, the addition of the latchable functionality takes up very little space in the package, thereby providing a space-efficient latchable package.

The support may comprise a tray. In this sense, a 'tray' may encompass any structure having a cavity, recess or detent for housing an article. Embodiments are envisaged in which the tray comprises a specially formed cavity, recess or detent that is sized and shaped to house a specific article, optionally in a push-fit.

For a particularly compact design, the latchable insert may be arranged in the base of the tray.

Alternatively, the latchable insert may define a cover of the tray that is movable between a closed configuration in which the latchable insert blocks access to the tray, and an open configuration in which the contents of the tray are accessible.

In this case, the latchable insert may comprise a retaining formation configured to retain the latchable insert in the closed configuration. For example, the tray may comprise opposite side walls, and the retaining formation may comprise a retaining feature that is configured to fit between side walls of the tray in a push-fit to retain the latchable insert in the closed configuration.

The retaining formation may comprise a pair of elongate channels that extend parallel to the side walls of the support, the channels extending out of the plane of the tab member to define side walls that fits inside the side wall of the support in a push fit. In one embodiment, the channels extend in a direction away from the support to define a rim, and the inner side walls of the channel fit inside the side walls of the support in a push fit. In another embodiment, the channels extend in a direction towards the support, and the outer side walls of the channel fit inside the side walls of the support in a push fit.

A spacing between the inner or outer side walls of the channels is substantially equal to a spacing between outer sidewalls of the support.

The pair of elongate channels may define left and right channels provided at left and right sides of the latchable insert, and the left and right channels may be joined at a front and a rear of the insert by channels that extend between left and right sides of the latchable insert.

The latchable insert may comprise a root portion that is coupled to the support and a lid portion that is movable with respect to the support to move the latchable insert into the open position. To his end, the insert may comprise a hinge between the root portion and the lid portion. The hinge may be defined by a crease, fold, score or perforation in the insert.

The hinge may in particular be defined by a fold, groove or channel that protrudes out of the plane of the tab member. In this case, the support may comprise a detent that receives the fold.

The root portion may comprise a coupling formation configured to couple the root portion to the support. In particular, the support may comprise opposite side walls, and the coupling formation may comprise protrusions configured to fit between the side walls in a push fit to couple the latchable insert to the support.

The latchable insert may be housed in a sleeve, the sleeve may be coupled to the support.

The latch feature of the latchable insert may protrude from an opening or aperture in the sleeve.

The sleeve may be is made of cardboard. The sleeve may support printed matter, for example information or advertising, which may be printed directly on to the sleeve.

The sleeve may comprise an insert portion that houses the insert and a root portion that is coupled to the support. The sleeve may comprise a hinge between the root portion and the insert portion. The hinge may be defined by a crease, fold, score or perforation in the sleeve.

The latch feature of the latchable insert may comprise one or more latch formations.

The latch feature of the structure may comprise one or more abutment surfaces against which the one or more latch formations abut to engage to co-operating latch features.

The abutment surfaces may be defined by an aperture on the structure.

The package may be configured such that when the package is in the first position and the latch features are engaged, the latch formation of the latchable insert protrudes through the aperture of the structure.

The support may comprise an aperture through which the latch formations of the latchable insert protrude. The aperture of the support may be provided on a side wall of the support.

The aperture of the support may be located on an upper portion of the sidewall, adjacent to a top cover of the support.

In embodiments where the insert is arranged in a base of the tray, the aperture of the support may be located on a lower portion of the sidewall, adjacent to a base of the support.

The tab member may may comprise a body portion and a deformable latch member connected to the body portion by at least one live hinge, the latch member incorporating the latch formation and the latch formation being moveable by a user in an unlatching direction that lies substantially in a plane of the tab member.

The deformable latch member may be defined by a region of low resistance between the body portion and the latch member.

The region of low resistance may be defined by a cut-out, ridge, channel, fold or detent in the tab member.

The region of low resistance may be defined by an elongate fold in the tab member. In this case, the fold may define a ridge that protrudes out of the plane of the support.

In this case, in embodiments where the tab member also may comprise a retaining feature defined by a channel, the ridge defining the region of low resistance and the channel defining the retaining formation may protrude from the plane of the tab member in opposite directions. The ridge and the channel may be located adjacent to one another. The ridge and the channel may together define an 'S' shaped fold in the tab member. Preferably, the ridge is located between the latch formation and the channel.

The tab member may have opposed major faces connected by opposed side edges and the latch formation may be moveable by a user in an unlatching direction that is substantially orthogonal to at least one side edge.

The latch member may incorporate at least an edge portion of said side edge.

The latch formation may comprise a locking formation of the edge portion. The locking formation may lie at an acute angle to an adjacent portion of the side edge. The latch formation may comprise a ramp formation opposed to the locking formation that lies at an obtuse angle to an adjacent portion of the side edge.

The region of low resistance may be an elongate region substantially aligned with and arranged near the side edge.

The latch member may be connected to the body portion by a pair of live hinges arranged at opposed ends of the latch member.

The latch formation may be integral with the latch member. The latch member may be integral with the body portion.

A second latch member may be provided on an opposed second side edge of the tab member.

The tab member may be a cut or stamped sheet. Alternatively, the tab member may be a thermo-formed sheet, or an injection-moulded sheet may be made by any other suitable method.

In cross section substantially orthogonal to the side edge, the body and the latch member may be of substantially the same thickness.

In cross section substantially orthogonal to the side edge, the latch member and the latch formation may be of substantially the same thickness.

The tab member may have a length-to-thickness ratio of at least 20:1. More particularly, the tab member may have a length-to-thickness ratio of at least 100:1.

The latch features may be located approximately mid-way along the package in the opening direction.

Coupling between the latchable insert and the support may be effected by means of an adhesive. Alternatively, coupling between the latchable insert and the support may be effected by means of a mechanical coupling. For example, the latchable insert may be configured to couple to the support by means of a push-fit. Coupling between the latchable insert and the support may be effected by arranging the latchable insert substantially inside the support. Other suitable coupling means may also be use. The latchable insert may be directly or indirectly coupled to the support.

The latchable package may comprise a withdrawal stop structure for limiting movement of the support in the opening direction. The withdrawal stop structure may comprise cooperating formations on the support and the structure.

The withdrawal stop structure may comprise opposed abutment surfaces on the support and on an internal surface of the structure.

At least one of the opposed abutment surfaces may be defined by a withdrawal stop latch movable into a latch position with respect to the support or the structure. The withdrawal stop latch may be a flap on the support or the structure.

The flap may be at or near an end of the support or the structure.

The structure may comprise at least one open end.

The support may comprise a blocking means for blocking the open end of the support when the support is in the first position. The blocking means may be configured to extend rearwardly into the structure to block the open end of the structure. The blocking means may comprise a blocking surface that lies against an interior surface of the structure when the support is in the first position.

In the second position, the support may protrude from a first end of the structure. A second end of the structure opposite the first end may comprise an access opening configured to permit access to an end of the support to allow the support to be pushed in the opening direction by a user's finger while the latch features are in a disengaged state. A base wall of the structure may be provided with a channel configured to permit the user's finger to move in the opening direction whilst pushing the support.

The access opening may be defined by a cut-out in an end wall of the structure. The end wall of the structure may define a side closure portion that extends between the cut-out and a side edge of the end wall. The end wall of the structure may define a top closure portion that extends between the cut-out and a top edge of the end wall.

The channel may be defined by a cut-out in the base wall of the structure. The base wall of the structure may define a side closure portion that extends between the cut-out and a side edge of the base wall. The base wall of the structure may define a front closure portion that extends between the cut-out and a front edge of the base wall.

The access opening and the channel may be defined by a single cut-out.

The channel may have a length in the opening direction and a width perpendicular to its length, the length being at least 1.5 times the width.

From a second aspect, the invention resides in a method of manufacturing a latchable package, the package comprising a support for supporting hazardous materials, a structure for selectively blocking access to at least a part of the support, and a substantially planar latchable insert, the structure and the latchable insert comprising co-operating latch features. The method comprises coupling the latchable insert to the support and arranging the support and attached latchable insert at least partially inside the structure such that the support and the insert are movable together in an opening direction from a first position in which the structure blocks access to the support and the cooperating latch features are engaged to a second position in which access to the support is permitted.

The invention provides a quick and easy method of assembling a package that requires only a simple coupling of the latchable insert to the support. Packages can therefore be made quickly and easily at a relatively low cost. The method is also easily scalable, in that both small batches and large batches can be made economically using the method.

The support may comprise a tray, and the step of coupling the latchable insert to the support may comprise placing the latchable insert into the tray.

In this case, the method may further comprise arranging the latchable insert such that the latchable insert may define a base of the tray. Alternatively, the method may further comprise arranging the latchable insert to define a lid of the tray.

The method may comprise inserting the latchable insert into the tray in a push fit.

The structure may comprise a side wall having at least one aperture and the latchable insert may comprise at least one latch formation. The method may further comprise arranging the latchable insert such that the latch formation protrudes through the aperture in the side wall.

The latch feature may be resiliently deformable to move the latch formation in an unlatching direction and the method may comprise moving the latch formation in the unlatching direction to allow placement of the latchable insert into the tray.

The method may further comprise allowing the latch formation to move in a latching direction opposite to the unlatching direction to cause the latch formation to protrude through the aperture in the side wall.

The step of coupling the latchable insert to the support may comprise adhering the latchable insert to the support. Alternatively or additionally, the step of coupling the latchable insert to the support may comprise mechanically fixing the latchable insert to the support.

The step of arranging the support and attached latchable insert at least partially inside the structure may comprise inserting the support and attached latchable insert into the structure until the co-operating latch features of the latchable insert and the structure are brought into engagement with one another, for example by pushing the support and attached latchable insert into the structure.

The latchable insert may comprise at least one latch formation and the structure may comprise a side wall having at least one aperture. The method may comprise inserting the support into the structure until the latch formation of the latchable insert protrudes through the aperture of the side wall of the structure.

The method may comprise assembling the structure by folding a blank. The method may comprise assembling the support by folding a blank. The step of coupling the latchable insert to the support may comprise folding a part of the support around the latchable insert.

From another aspect, the invention resides in a latchable package comprising a support arrangement for supporting one or more items and a structure for selectively blocking access to the one or more items. The support arrangement is movable in an opening direction from a first position in which the structure blocks access to the one or more items to a second position in which one or more items are accessibly clear of the structure. The support arrangement and the structure comprise co-operating latch features that, when the support arrangement is in the first position, are configured to be movable by a first finger of a user's hand between an engaged state in which the support arrangement is prevented from moving in the opening direction, and a disengaged state in which the support arrangement is permitted to move in the opening direction. The structure comprises an access opening configured to permit access to the support arrangement to allow the support arrangement to be pushed in the opening direction by a second finger of a user's hand while the latch arrangement is in the disengaged state. A wall of the structure is provided with a channel configured to permit the second finger of the user's hand to move in the opening direction whilst pushing the support arrangement.

In this way, the invention provides a package that can only be opened by simultaneously disengaging a latch and pushing the support in the opening direction. This action requires a degree of manual dexterity that is easy for adults, but that cannot be achieved by a child, thereby providing a child-resistant package. By virtue of the access opening and the channel, a user can disengage the latch using a first finger, access the support to push it out of the first position using a second finger of the same hand, and continue to push the support via the channel towards the second, open configuration. Provision of the access opening and the channel protects otherwise vulnerable parts of the package from access by a child, whilst still allowing sufficient access to open the package by an adult when needed. The package therefore allows a combination of latchability and one-handed operation.

The access opening may be defined by a cut-out in an end wall of the structure. The end wall of the structure may define a side closure portion that extends between the cut-out and a side edge of the end wall. The end wall of the structure may define a top closure portion that extends between the cut-out and a top edge of the end wall.

Alternatively or additionally, the access opening may be defined by a cut-out in the base wall of the structure.

The support may comprise a grip feature on its base, and the access opening in the structure may provide access to the grip feature. The grip feature may comprise an aperture in the base of the structure.

The channel may be defined by a cut-out in the base wall of the structure. The base wall of the structure may define a side closure portion that extends between the cut-out and a side edge of the base wall.

The base wall of the structure may define a front closure portion that extends between the cut-out and a front edge of the base wall.

The channel may have a length in the opening direction and a width perpendicular to its length, the length being at least 1.5 times the width. The channel and the access opening may be contiguous with one another.

The latch features may be located approximately mid-way along the package in the opening direction. The support arrangement and the structure may comprise two sets of latch features arranged on opposite sides of the package. The or each latch feature may comprise at least one latch formation that is movable in an unlatching direction into the disengaged state.

The latch formation and the access opening may be positioned such that a user can move the latch member in the unlatching direction using the first finger of the user's hand and can simultaneously push the support arrangement using a second finger of the same hand.

A spacing in the opening direction between the latch formation and the access opening may be no greater than 12 cm. A width of the package in a direction perpendicular to the opening direction is no greater than 13 cm.

The support arrangement may comprise a component made of a plastics material. The component may be a vacuum-formed component or an injection-moulded component.

The support arrangement may comprise a support for supporting one or more items and a latchable insert in the form of a substantially planar tab member that may comprise the latch feature, the latchable insert being coupled to the support such that the insert and support are movable together in the opening direction.

The invention also extends to a method of opening the latchable package described above, the method comprising: moving the latch feature into a disengaged state using a first finger of a user's hand; pushing the support arrangement in the opening direction while the latch feature is disengaged using a second finger of the same hand to move the support out of the first position; and moving the second finger along the channel in the base wall of the structure to push the support arrangement further in the opening direction towards the second position.

It will be appreciated that preferred and/or optional features described above in relation to one aspect or embodiment of the invention may be used alone, or in appropriate combination with other aspects and embodiments of the invention also.

BRIEF DESCRIPTION OF THE FIGURES

In order that the invention may be more readily understood, reference will now be made, by way of example, to the accompanying drawings, in which.

DETAILED DESCRIPTION OF EMBODIMENTS OF THE INVENTION

Figure 1:
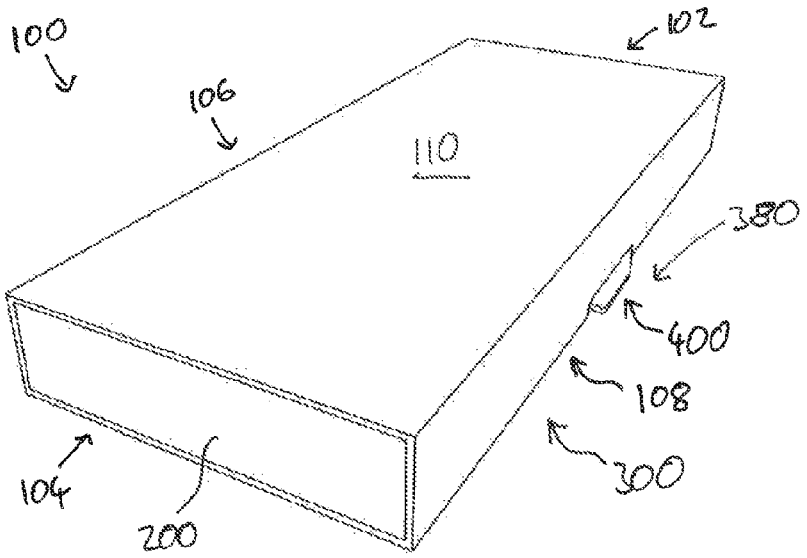
FIG. 1 is a perspective view of a latchable package according to an embodiment of the invention in a first or secured configuration.
Figure 2:
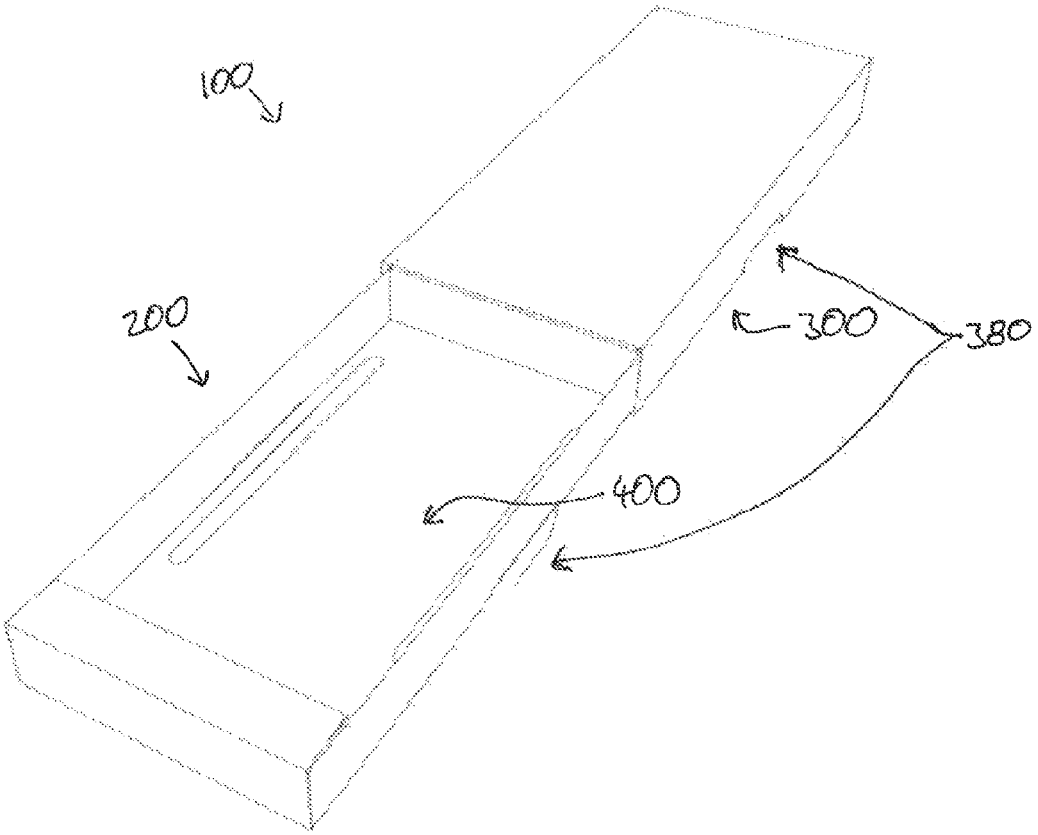
FIG. 2 is a perspective view of the latchable package of FIG. 1 in a second or access configuration.
Figure 3:
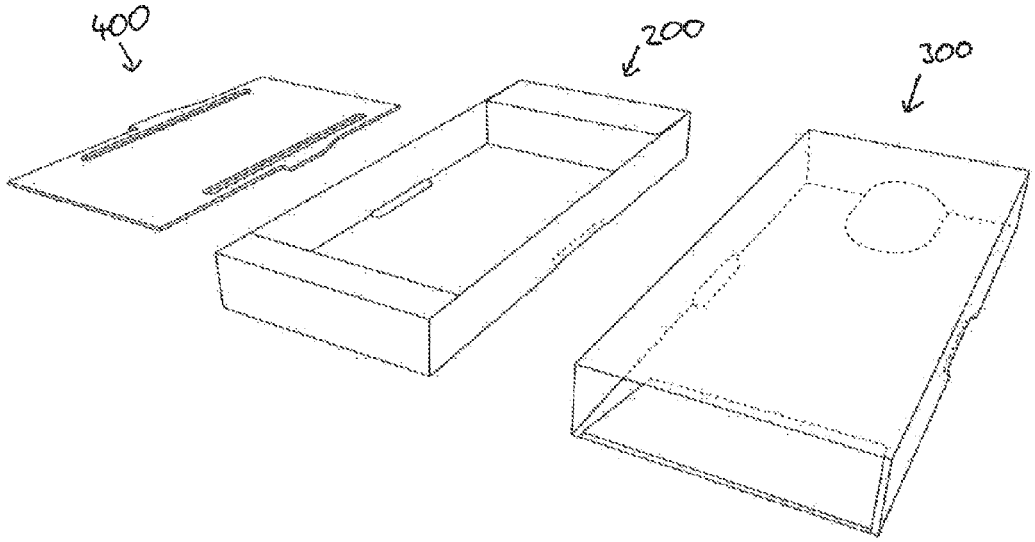
FIG. 3 is a perspective view of a latchable insert, a support and a structure that constitute disassembled components of the package of FIG. 1.

Referring to FIGS. 1, 2 and 3, a child resistant package 100 comprises a support 200 for storing hazardous materials (not shown), a structure, in the form of a sleeve 300 for blocking access to the hazardous materials, and a latchable insert in the form of a substantially planar tab member 400 for latching the package 100. The package 100 comprises a rear end 102, a front end 104, a left side 106, a right side 108, an upper side 110, and a lower side (not shown).

The package 100 is moveable by a user between a fully-closed or secured position, shown in FIG. 1, in which access to the hazardous materials is blocked by the sleeve 300, and a fully-open or access position, shown in FIG. 2, in which access to the hazardous materials is permitted.

The tab member 400 is coupled to the support 200 such that the tab member 400 and support 200 are movable together in an opening direction from the secured position to the access position.

The sleeve 300 and the tab member 400 comprise co-operating latch features, indicated generally at 380. The latch features 380 are configured to engage when the tab member 400 and the support 200 are arranged in the secured position.

The components of the latchable package will now be described with reference to FIGS. 4 to 6.

Figure 4:
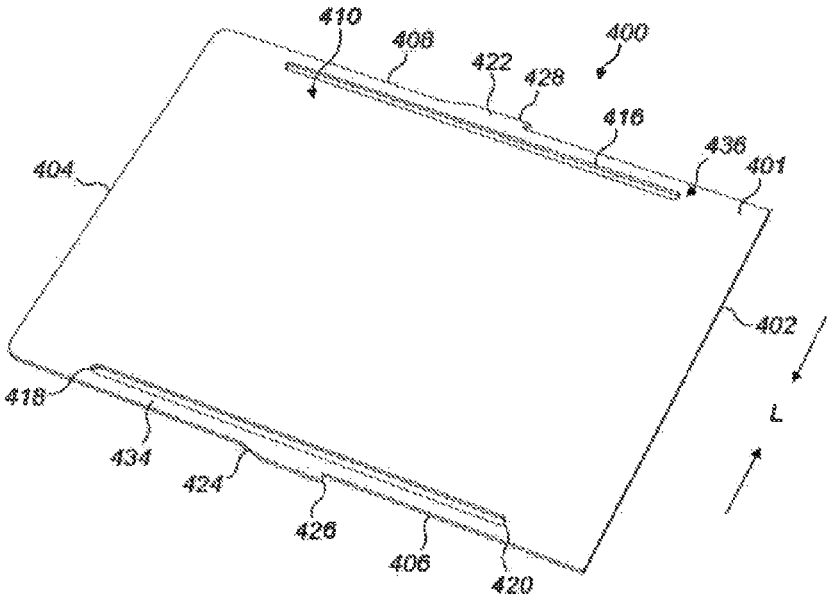
FIG. 4 is a perspective view of the latchable insert of FIG. 3.

As best seen in FIG. 4, the tab member 400 is a panel or substrate formed from a substantially flat sheet, which is made from a flexible cardboard or plastics material. The tab member 400 is planar such that it extends in a plane parallel to the lower side of the blister-pack when it is housed in the package 100 (see FIG. 2). The panel or substrate may be, for example, a cut or stamped sheet, or it may be an injection moulded sheet.

A body 401 forms the majority of the tab member 400. Regions of low resistance in the body 401, exemplified here as cut-outs 416 in the body 401 define latch members 434, which are joined to the body 401 by live hinges 436.

The tab member 400 comprises a front edge 402, a rear edge 404, a left edge 406, a right edge 408, an upper side 410, and a lower side (not shown).

The distance between the front and rear edges 402, 404 defines a length of the tab member 400, and the distance between the left and right edges 406, 408 defines its width. The spacing between the upper side 410, and the lower side defines a thickness of the tab member 400, which is substantially less than its length or width.

In the embodiment illustrated, the sheet is a styrene sheet having a thickness of approximately 1 mm and a length of approximately 12 cm. The sheet therefore has a length-to-thickness ratio of approximately 120:1. The sheet is of a stiffness that is great enough to impart self-supporting stiffness to the sheet (i.e. the sheet is not significantly deformed under its own weight), but low enough to allow the sheet to flex to some degree. The sheet also has a yield stress that is high enough to allow substantial flexing of the sheet without plastic deformation.

The cut-outs 416 in the body 401 that define the latch members 434 take the form of left and right slots aligned respectively with left and right edges 406, 408 of the tab member 400. The slots 416 are elongate, being substantially oblong in shape, and extend parallel to the left and right edges 406, 408 along the majority of the length of those edges 406, 408.

The length of each slot 416 is substantially greater than the width of each slot. In the embodiment illustrated, the width of each slot 416 is approximately 2 mm, or twice the thickness of the tab member 400, and the length of each slot 416 is approximately 8 cm, or approximately forty times its width.

The elongate slots 416 terminate at front and rear ends 420, 418, which are spaced a distance from the respective front and rear edges 402, 404 of the tab member 400. In the embodiment illustrated, the elongate slots 416 have a length that is approximately 70% of the length of the tab member 400, and are arranged centrally with respect to the front and rear edges 404, 402 of the tab member 400.

In this way, the spacing between the front end 420 of the slot 416 and the rear edge 404 of the tab member 400 is equal to the spacing between the rear end 418 of the slot 416 and the front edge 402 of the tab member 400. This spacing is equal to approximately 15% of the length of the tab member 400.

As best seen in FIG. 4, at the left and right edges 406, 408 of the tab member 400, each latch member 434 is provided with a latch formation 422. Each latch formation 422 is disposed at a substantially central position on the respective left or right edge 406, 408 of the tab member 400, and protrudes outwardly from that edge 406, 408.

The tab member 400 is symmetrical about its central longitudinal axis. Therefore, the left and right latch formations 422 are mirror images of each other and function identically but in opposite directions. It will be appreciated that the latch formations 422 are spaced apart from one another by a distance that corresponds approximately to the width of the tab member 400. In the embodiment shown, this distance is sufficiently large that an adult, having relatively large hands, could depress both latch formations 422 simultaneously using only one hand, for example between thumb and forefinger, but a child, having relatively small hands, could not.

Considering for convenience the right edge 408 and right latch member 434 and latch formation 422 only, the latch member 434 is formed from the sheet, and hence is formed integrally with the body 401 of the tab member 400. Thus, the latch member 434 is of substantially the same thickness as the body 401 of the tab member 400, and lies in the same plane.

The latch member 434 is an elongate beam or arm that lies outboard of the slot 416 and encompasses a portion of the right edge 408 of the tab member 400. More specifically, the latch member 434 encompasses at least the portion of the right edge 408 of the tab member 400 that includes the latch formation 422. The latch member 434 terminates forwardly and rearwardly in live hinges 436 that are disposed longitudinally outboard of the respective front and rear ends 418, 420 of the slot 416.

The spacing between the slot 416 and the right edge 408 of the tab member 400 defines the width of the latch member 434. In the embodiment illustrated, the width of the latch member 434 is approximately 2.5 mm, which is slightly greater than the width of the slot 416. Consequently, the width of the latch member 434 is large enough that the latch member 434 is not easily broken and can provide structural support to the latch formation 422, but small enough that the latch member 434 can be deformed easily.

Figure 5:
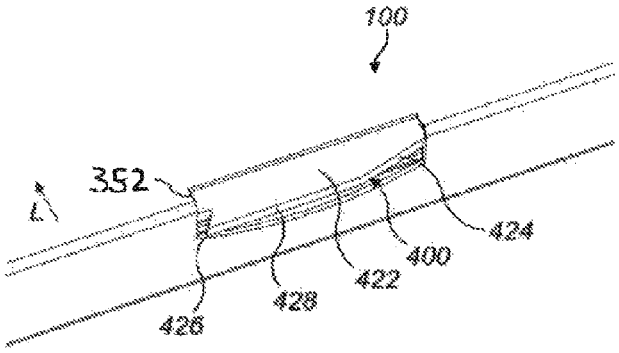
FIG. 5 is a partial enlarges view of latch formation forming part of the latchable insert of FIG. 4, when incorporated in the package of FIG. 1 and when the package is in the first configuration.

Referring to FIGS. 4 and 5, the latch formation 422 comprises a rear edge 424, a front edge 426, and an outer edge 428. The outer edge 428 of the latch formation 422 lies substantially parallel to the right side 408 of the tab member 400. The perpendicular spacing between the outer edge 428 of the latch formation 422 and the right edge 408 of the tab member 400 defines a width of the latch formation 422. The latch formation 422 is of a relatively small width compared to the width of the tab member 400: specifically, in the embodiment illustrated, the width of the latch formation 422 is approximately 1.5 mm, and is hence approximately 1.5 times the thickness of the tab member 400.

The rear edge 424 of the latch formation 422 extends rearwardly between the outer edge 428 of the latch formation 422 and the right edge 408 of the tab member 400. The rear edge 424 is tapered so as to extend simultaneously inwardly, towards a centre of the tab member 400, and rearwardly, towards the rear edge 404 of the tab member 400, such that the rear edge 424 meets both the outer edge 428 of the latch formation 422 and the right edge 408 of the tab member 400 at an obtuse angle of approximately 165°. Thus inclined, the rear edge 424 of the latch formation 422 defines a ramp.

The front edge 426 of the latch formation 422 also extends rearwardly between the outer edge 428 of the latch formation 422 and the right edge 408 of the tab member 400. The front edge 426 is inclined so as to extend simultaneously inwardly and rearwardly, such that it meets both the outer edge 428 of the latch formation 422 and the right edge 408 of the tab member 400 at an acute angle of approximately 55°. In this way, the front edge 426 of the latch formation 422 defines an under-cut notch or a shoulder. When the tab member 400 is arranged in the package 100 in the closed position, the shoulder abuts a corresponding abutment surface 352 on the sleeve 300 and so acts as a locking formation.

Where the latch formation 422 meets the right edge 408 of the tab member 400, the spacing between the front and rear edges 424, 426 of the latch formation 422 defines the length of the latch formation 422. In the embodiment illustrated, the length of the latch formation 422 is approximately 20% of the length of the slot 416.

When a user applies an inward force to the latch formation 422, for example by squeezing the left and right latch formations 422 between their thumb and middle finger, the latch member 434 of the tab member 400 is resiliently deformed in an inward direction.

The slot 416 allows the latch member 434 to bend inwardly about the live hinges 436, such that a central portion of the latch member 434 occupies the space of the slot 416. In this way, the latch member 434 is effectively subjected to a three-point bend, with outward bending moments being applied at the live hinges and an opposed inward bending moment being applied at the latch formation 422 (i.e. at the centre of the latch member 434) by the user's finger or thumb.

The extent of deflection of the latch member 434 is therefore restricted by the width of the slot 416. The width of the slot 416 is selected to be narrow enough that deflection of the latch member 434 is restricted to a degree of deflection that is within the elastic limits of the latch member 434.

This bending of the latch member 434 allows the latch formation 422 to be moved in an unlatching direction L that extends substantially orthogonally to the left and right edges 406, 408 of the tab member 400.

In this way, the latch formation 422 is naturally and resiliently biased outwardly in a first, engaged position in which the front, rear and outer edges 424, 426, 428 of the latch formation 422 protrude outwardly beyond the right edge 408 of the tab member 400. Upon application of an inward force to the latch formation 422 by a user, the latch formation 422 can be resiliently moved in the unlatching direction L to a second, disengaged position, in which the outer edge 428 of the latch formation 422 lies substantially flush with, or inwardly of, the right edge 408 of the tab member 400. When the inward force is removed, the latch formations 422 return to the first, engaged position once more.

The sheet-like configuration of the tab member 400 means that it can be formed from a single sheet of material, for example by a simple process of cutting or stamping. The sheet material itself is inexpensive, and the manufacturing process is fast, efficient and similarly inexpensive. Alternatively, the tab member 400 could be made by other inexpensive methods, for example by injection moulding a plastics material. In this way, the cost of the package can be kept relatively low. Furthermore, the latch-carrying component is so thin that it takes up only minimal space in the package when stacked with other components such as the blister pack, thereby reducing its size, and improving its aesthetic appeal.

Figure 6:
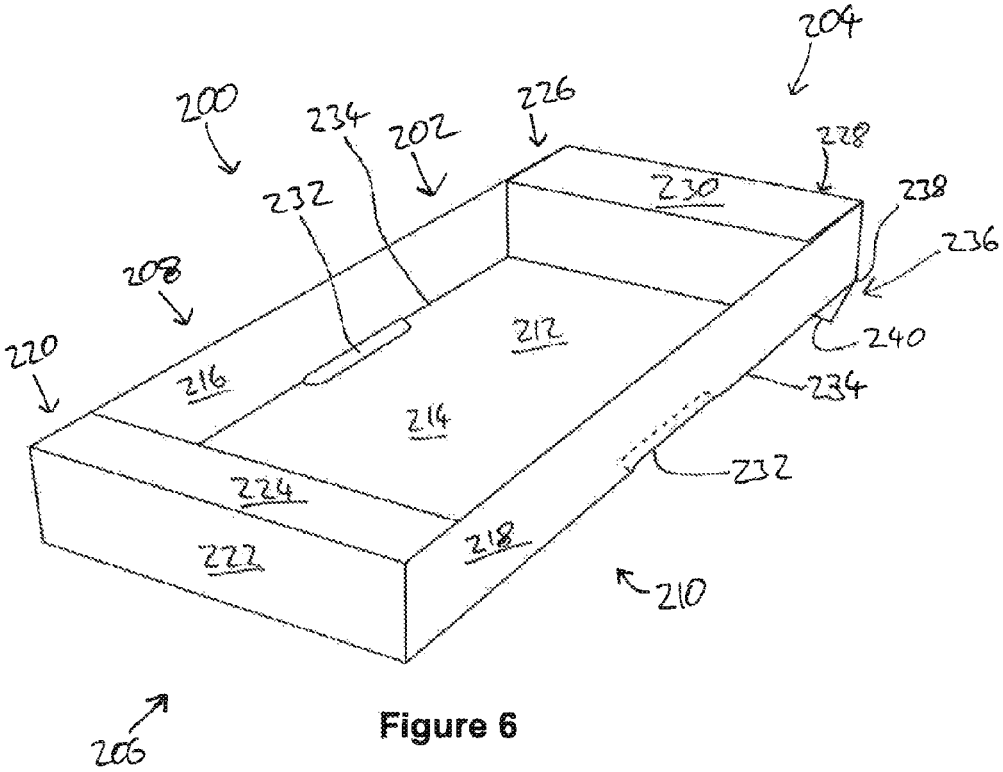
FIG. 6 is a perspective view of the support of FIG. 3.

Referring now to FIG. 6, the support 200 comprises a main body that defines a tray 202. The tray 202 comprises a rear end 204, a front end 206, a left side 208, a right side 210, and a base 212.

The base 212 of the tray 202 is defined by a generally planar base wall 214. Left and right side walls 216, 218 are upstanding from the base wall 214 at respective left and right sides 208, 210 of the tray 202. The front end 206 of the tray 202 is provided with a front blocking means 220 that defines a front wall 222 of the tray and a front blocking surface 224 that lies perpendicular to the front wall 222 and that extends a short distance from the front wall 222 into the tray 202. The rear end 204 of the tray 202 is provided with a similar rear blocking means 226 that defines a rear wall 228 of the tray 202 and a rear blocking surface 230 that lies perpendicular to the rear wall 228 and that extends a short distance from the rear wall 228 into the tray 202.

The left and right sides 208, 210 of the tray 202 are provided with elongate apertures 232. Each aperture 232 sits over an edge 234 defined where each side wall 216, 218 meets the base wall 214. In this way, each aperture 232 extends a short distance up the side wall 216, 218 and a short distance into the base wall 214.

In the assembled package 100, the apertures 232 receive the latch formations 422 of the tab member 400 (see FIG. 2).

At the rear end 204 of the tray 202, the support 200 is provided with a withdrawal stop formation in the form of a withdrawal stop latch 236. The withdrawal stop latch 236 is a flap that extends rearwardly from a lower rear edge of the tray 202. The withdrawal stop latch 236 comprises a crease 238 where the flap 238 meets the lower rear edge of the tray 202, and a front edge 240 opposite the crease.

In the embodiment shown, the support 200 is made of cardboard, and is formed by folding a flat blank in the configuration shown. However, the support 200 may be formed from any suitable material and by any suitable method. For example, the support 200 may be formed from a plastics material such as impact styrene by vacuum forming or injection moulding.

Figure 7:
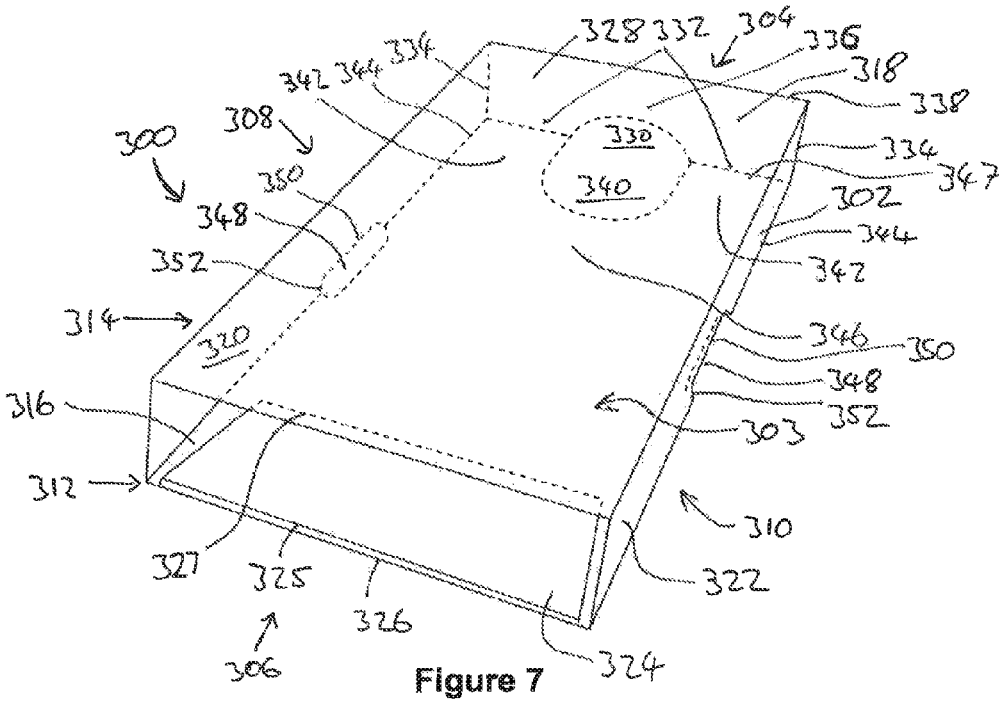
FIG. 7 is a perspective view of the structure of FIG. 3 with the walls made transparent to reveal obscured features.

Referring now to FIG. 7, the sleeve 300 comprises a main body 302 in the form of a shell that defines an interior space 303. The sleeve has a rear end 304, a front end 306, a left side 308, a right side 310, a base 312 and a top 314.

The base 312 and top 314 of the sleeve 300 are defined respectively by a generally planar base wall 316 and a generally planar upper wall 318. Left and right side walls 320, 322 join the base wall 316 to the upper wall 318 at respective left and right sides 308, 310 of the sleeve 300.

The front end 306 of the sleeve 300 is open. At the front end 306, the base wall 316 is provided with a withdrawal stop latch in the form of a flap 324. The flap 324 extends rearwardly from a front edge 326 of the base wall 316 into the interior space 303. The withdrawal stop latch 324 comprises a crease 325 where the flap 324 meets the front edge 326 of the base wall 316, and a rear edge 327 opposite the crease 325.

The rear end 304 of the sleeve 300 is partially closed by a rear end wall 328. The rear end wall 328 comprises a cut-out that defines an access opening 330 in the rear of the package 100.

The cut-out 330 extends only partially along the width of the rear end wall 328 and only partially up the height of the rear end wall 328. In this way, the rear end wall 328 of the structure 300 defines side closure portions 332 that extend between the cut-out 330 and side edges 334 of the rear end wall 328 and a top closure portion 336 that extends between the cut-out 330 and a top edge 338 of the rear end wall 328.

At the base 312 of the sleeve 300, the base wall 316 is provided with a channel 340 defined by a cut-out in the base wall 316. The channel 340 extends from a rear edge 347 of the base wall 316 forwardly towards the front end 306 of the sleeve 300.

The channel 340 has a length in the opening direction that is greater than its width in a direction perpendicular to the opening direction. More specifically, the length of the channel is at least 1.5 times the width of the channel, and is preferably approximately twice the width of the channel.

The channel 340 extends only partially across the width of the base wall 316, and only partially along the length of the base wall 316. In this way, the base wall 316 of the sleeve 300 defines side closure portions 342 that extend between the channel 340 and left and right side edges 344 of the base wall 316 and a front closure portion 346 that extends between the channel 340 and the front edge 326 of the base wall 316.

In the embodiment shown, the cut out that defines the access opening 330 and the cut out that defines the channel 340 are continuous with one another so as to define a single cut-out that straddles the rear edge 347 of the sleeve 300 to define both access opening 330 and the channel 340.

At the left and right sides 308, 310 of the sleeve, the base wall 316 comprises left and right side edges 344 defined where the base wall 316 meets the left and right side walls 320, 322. Each side 308, 310 of the sleeve is provided with an elongate aperture 348 that straddles the respective left or right side edge 344. In this way, each elongate aperture 348 extends a short distance up the side wall 320, 322 and extends a short distance into the base wall 316.

An edge surface 350 surrounding the aperture 348 comprises a front edge that defines an abutment surface or abutment edge 352 on the sleeve 300. In use, the latch formation 422 on the tab member 300 abuts against the abutment edge to engage with the latch formation 422, thereby preventing movement of the tab member 300 and hence the support 200.

Each aperture 348 is disposed centrally between the front and rear ends 308, 310 of the sleeve 300, and is of a length that is slightly greater than the length of a latch formation 422 of the tab member 400. In this way, in the assembled package 100, the latch formation 422 can be received in the aperture 348.

In the embodiment shown, the sleeve 300 is made of cardboard, and is formed by folding a flat blank in the configuration shown. However, the sleeve 300 may be formed from any suitable material and by any suitable method. For example, the support 200 may be formed from a plastics material such as impact styrene by vacuum forming or injection moulding.

The construction and operation of the fully-assembled package will now be described in more detail with reference to FIGS. 8 and 9.

Figure 8:
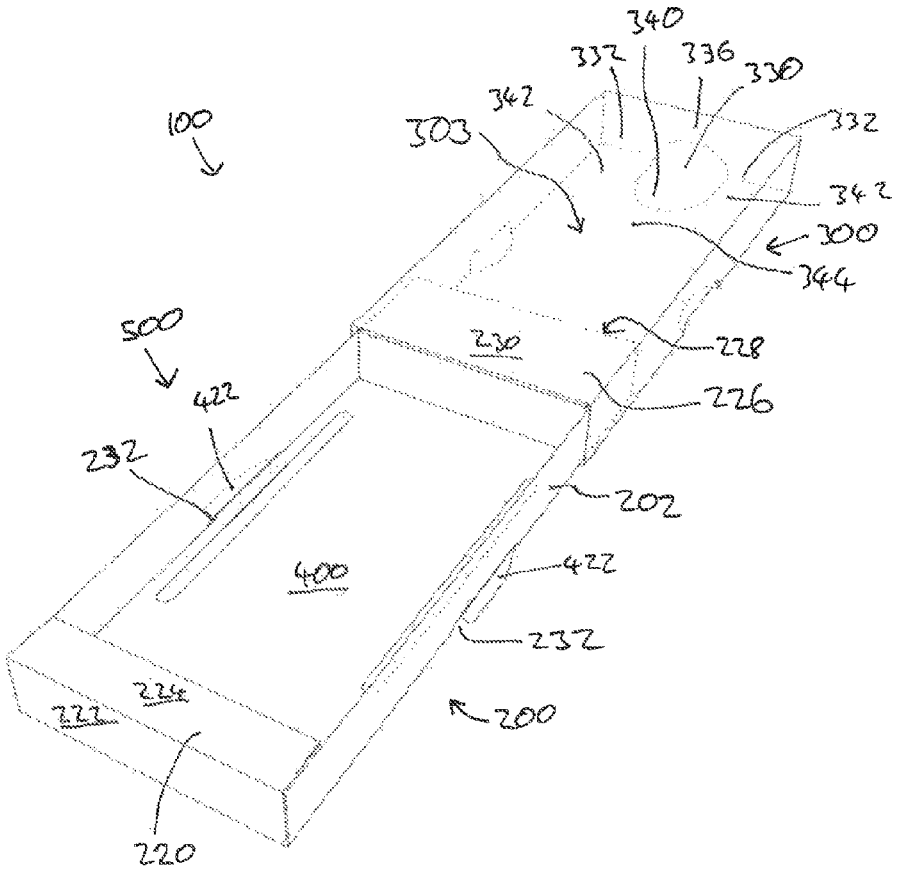
FIG. 8 is a perspective view of the latchable package of FIG. 1 in the second configuration, with the structure and support made transparent to reveal obscured features.

Referring to FIG. 8, in the assembled package 100, the tab member 400 is arranged inside the tray 202 of the support 200. In this way, the support 200 and the tab member 400 together define a support arrangement 500.

The tab member 400 is arranged at the base 212 of the tray 202. In this way, the tab member 400 takes up only a very small volume of the tray that would otherwise be available for holding items. Each latch formation 422 of the tab member 400 protrudes through the respective aperture 232 at the side of the tray 202. In this way, the latch formation 422 is accessible through the tray 202.

The support arrangement 500 is slidably arranged inside the interior space 303 defined by the sleeve 300 so that the support 200 and the tab member 300 can be moved back and forth together between the access position and the secure position (see FIGS. 1 and 2).

Figure 9A:
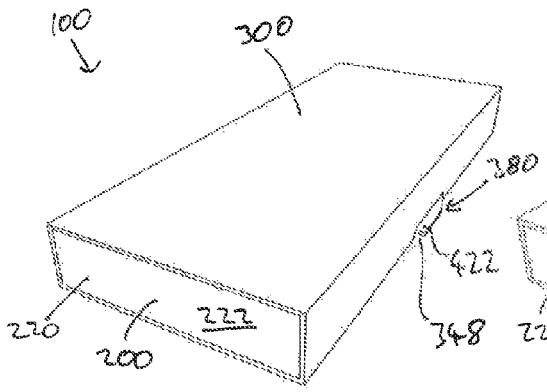
FIGS. 9A and 9B are top and bottom perspective views respectively of the latchable package of FIG. 1 in the first configuration.
Figure 9B:
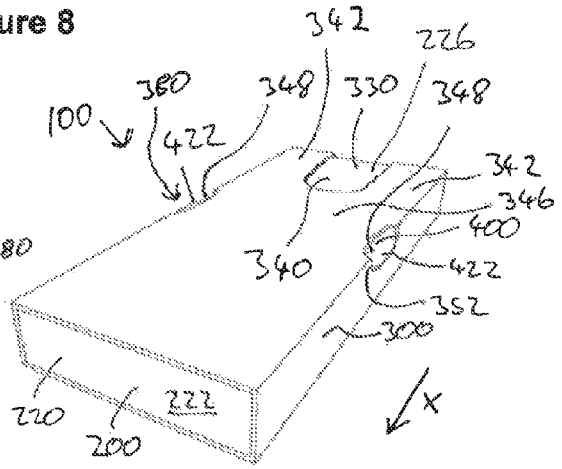

As best seen in FIGS. 9A and 9B, when the support 200 and the tab member 400 are arranged in the secure position, the latch formations 422 on the tab member 400 protrude through the apertures 348 on the sleeve 300. Together, the latch formations 422 of the tab member 400 and the abutment surfaces 352 on the wall surrounding the apertures 348 of the sleeve 300 define the co-operating latch features 380 that engage when the support 200 and the tab member 400 are in the secure position.

The support 200 and sleeve 300 each have features that contribute to the child-resistance of the package and make it difficult for a child to access the contents of the tray 202 when the package 100 is secured.

Referring back to FIG. 6, the blocking means 220, 226 on the tray 202 of the support act to block the ends of the package 100 to make it difficult for a child to access the contents of the tray 200 when the package is secured. In particular, front and rear walls 222, 228 block the open end at the front of the package 100 and the access opening 330 at the rear of the package 100, and the blocking surfaces 224, 230 lie flush against the upper wall 318 of the sleeve 300 to prevent a child accessing the tray by working a finger over the front or rear wall 222, 228.

The closure portions 332, 336, 342, 346, of the rear and base walls 328, 316 of the sleeve 300 (see FIG. 8) also act to obstruct access the contents of the tray 200 when the package 100 is secured, whilst still providing the aperture 330 that defines the access opening 330 and channel 340. In particular, the closure portions block access to any gaps between the sides and top of the tray 202 and the interior surface of the sleeve 300, thereby preventing a child working a finger between the tray and the sleeve to access the contents.

Figure 10A:
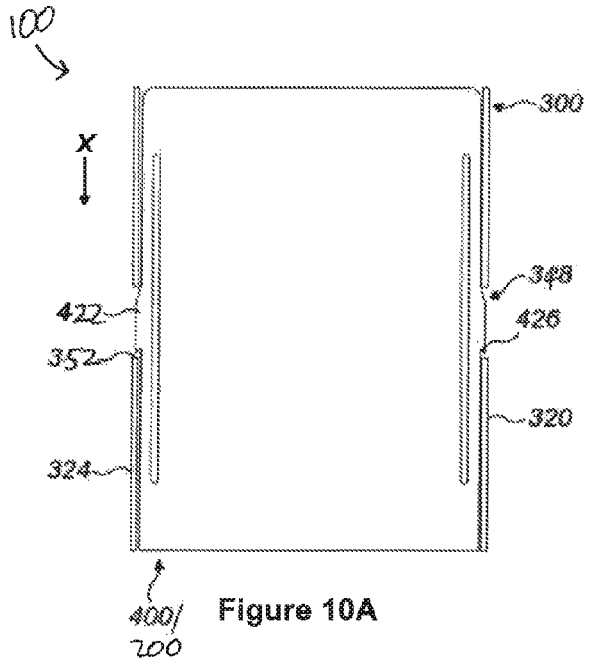
FIGS. 10A and 10B are schematic plan views of the latchable insert of FIG. 4 arranged in the package of FIG. 1, with the latch formations in an engaged state.
Figure 10B:
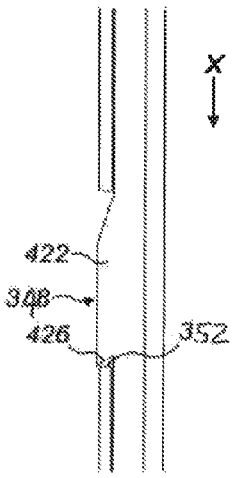

Referring now to FIG. 10, when the package 100 is secured and the latch formations 422 are in the engaged state, they are located in the apertures 348 of the sleeve 300, with the front edges 426 of the latch formations 422 protruding into the apertures, and facing the abutment surfaces 352 on the walls surrounding the apertures 348.

If a user attempts to move the support and hence the tab member 400 in the direction of arrow X when the latch formations 422 are in their engaged state, the front edges 426 of the latch formations 422 bear against the respective abutment edges 352 of the apertures 348, as shown in FIG. 14B, which prevents movement of the tab member 400 in the direction of arrow X. If a user continues to attempt to force the support and hence the tab member in the direction of arrow X once the front edges 426 of the latch formation 422 are already bearing against the abutment edge 352 of the apertures 328, the inclination of the front edge 426 of the latch formation 422 forces the latch formations 422 outwardly, further away from the disengaged state.

Figure 11:
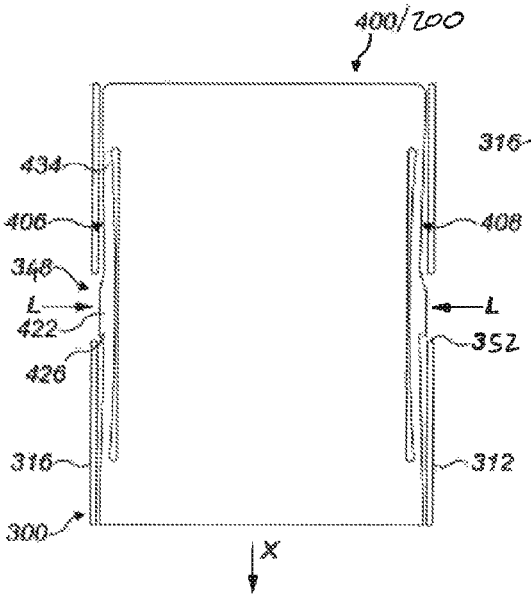
FIG. 11 is a schematic plan view of the latchable insert of FIG. 4 arranged in the package of FIG. 1, with the latch formations in a disengaged state.
Figure 12:
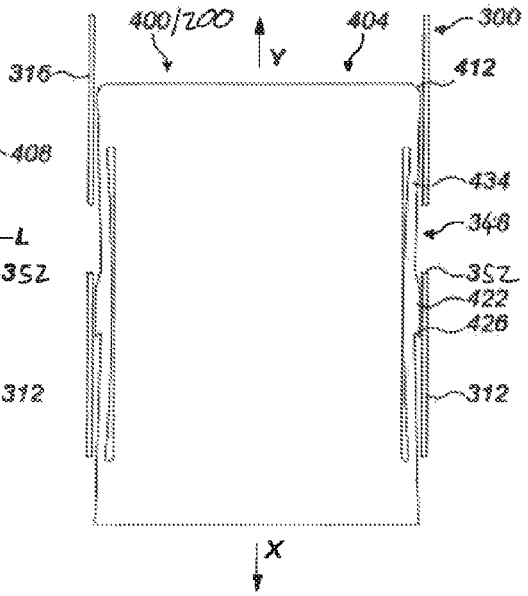
FIG. 12 is a schematic plan view of the latchable insert of FIG. 4 arranged in the package of FIG. 1, with the latch formations in a disengaged state and with the latchable insert displaced slightly in an opening direction.

Movement of the support 200 and hence the tab member 400 in direction X can only occur when the latch formations 422 are simultaneously brought into their disengaged state by a user pressing the latch formations 422 towards each other in a squeezing action between a user's thumb and middle finger, as shown in FIG. 11. As the user squeezes the latch formations 422, the latch members 434 move in the unlatching direction L, which is substantially orthogonal to the side edges 406, 408, and is in the plane of the tab member 400. The latch members are retained in this plane at least in part by the 214 of the tray 202. In other words, the base wall of the tray (visible in FIG. 6) acts to counteract any out-of-plane flexibility of the sheet to retain the latch members 434 in the plane of the tab member 400.

By moving the latch members 434 in the unlatching direction, the latch members 434 are moved into the disengaged state. In the disengaged state, the front edges 426 of the latch formations 422 are arranged inwardly of the side walls of the sleeve 300. In this way, when the user moves the tab member 400 in the direction of arrow X, the front edges 426 of the latch formations 422 do not abut the abutment edges 352 of the apertures 328, and the tab member 400 and hence the support 200 are free to slide within the sleeve 300 in the opening direction X.

Once the user has moved the latch formations 422 in the unlatching direction so that the latch formations 422 are in the disengaged state, the support 200 must be pushed in the opening direction X to open the package 100. To this end, whilst pinching the latch formations 622 between a user's thumb and middle finger, the user employs another finger of the same hand, for example the forefinger, to access the support 200 through the access opening 330 at the rear of the package 100. The user pushes the support 200 in the opening direction X to move the latch formations 422 into a position inside the side walls 320, 322 of the sleeve 300. In other words, the user pushes the support 200 using the access opening 330 in the opening direction X until the support 200 and hence the tab member 400 have been moved just away from the secured position.

Referring back to FIG. 9B, after the support 200 and tab member 400 have been moved just away from the secured position, the user continues pushing the support 200 further in the opening direction X using their forefinger. To achieve this, the user's forefinger must follow the channel 340 in the base wall 314 of the sleeve 300. By virtue of the channel 340 the user's forefinger can remain in continuous contact with the support 200 to push it in the opening direction X, until the user's forefinger reaches the end of the channel 340. At that point, the support 200 has been moved towards to access position to a sufficient extent that the user can access the contents of the tray 202.

The latch formations 422, access opening 330 and channel 340 are all positioned to enable the user to disengage the latch formations 422 and simultaneously push the tray in the opening direction X using a single hand. To this end, the spacing between the latch formations 422 in a direction perpendicular to the opening direction is no greater than the typical thumb-to-middle-finger span of an adult hand (for example, no greater than 13 cm which is a maximum span of a typical adult, or more preferably no greater than 10.5 cm), and the spacing between the latch formations 422 and the access opening 330 in a direction parallel to the opening direction is no greater than the typical thumb-to-forefinger span of an adult hand (for example, no greater than 12 cm).

The presence of the channel 340 allows the user to continue pushing the support 200 in the opening direction using a single hand. The contents of the tray can be accessed when the package has been opened as much as the channel 340 will allow. Alternatively, the package can be opened fully, for example using a two-handed operation in which a user holds the sleeve 300 with one hand and pulls the front end of the support 200 with the other hand.

The need to squeeze the latch formations 422 together whilst simultaneously accessing and pushing the support 200 via the access opening 330 and channel 340 requires a level of dexterity that is difficult for children, but that is easy for adults. It is therefore very difficult for a child to open the package, while an adult can easily open the package using only one hand. The latch formations 422, access opening 330 and channel 340 therefore work in synergy to provide a package that is child-resistant and yet can be easily opened with one hand.

The latchable insert in the form of the tab member 200, in conjunction with the apertures on the sleeve 300, acts to provide child resistant functionality to the package 100 whilst taking up very little space within the package.

Figure 13:
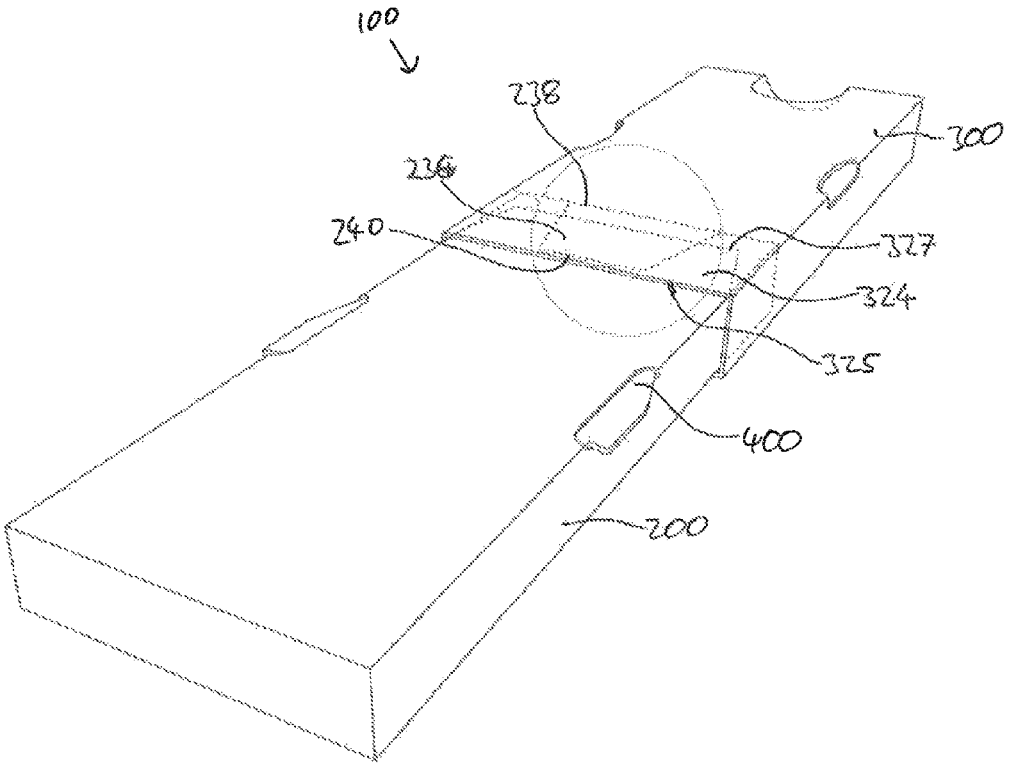
FIG. 13 is a perspective view showing the base of the package of FIG. 1, in the second configuration and with the structure transparent to reveal obscured features.
Figure 14:
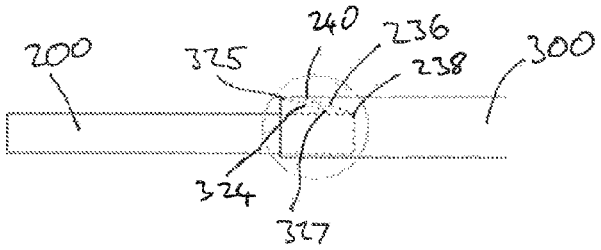
FIG. 14 is a partial side view of the package of FIG. 13.

Referring to FIGS. 13 and 14, further movement of the support 200 in the opening direction brings the support 200 and the tab member 400 into the fully-open state. In this fully-open state, the withdrawal stop latches 324, 336 on the sleeve 300 and the support 200 engage with one another to prevent further movement of the support 200 in the opening direction.

In particular, when the withdrawal stop latches 324, 336 are engaged, the front edge 240 of the withdrawal stop latch on the support 236 abuts against the crease 325 of the withdrawal stop latch 324 on the sleeve, and/or the rear edge 327 of the withdrawal stop latch 324 on the sleeve 300 abuts against the crease 238 of the withdrawal stop latch 236 on the support 200.

In this way, the withdrawal stop latches 324, 336 act to limit movement of the support 200 in the opening direction, so that the support 200 and the tab member 400 cannot be easily removed from the sleeve 300.

To return the support 200 from the fully-open state the user simply pushes the support 200 back into the sleeve 300. As the support 200 is pushed into the sleeve 300, the side walls 320, 322 of the sleeve 300 initially push the left and right latch formations 422 into the disengaged state. The ramp-like taper of the rear edges of the latch formations 422 enables this inward movement. However, when the latch formations 422 reach their associated apertures 348 in the side walls 320, 322, they are biased into the engaged state. Thus, the left and right latch formations 422 engage in a snap fit with the sleeve 300 when the support 200 is returned into the sleeve 300 in direction X. The snap fit gives a clear indication to the user that the package 100 has been returned to the fully-closed state, and can therefore be stored safely.

A method of making the package 100 described above by assembling its component parts will now be described with reference to FIGS. 15A to 15D.

Figure 15A:
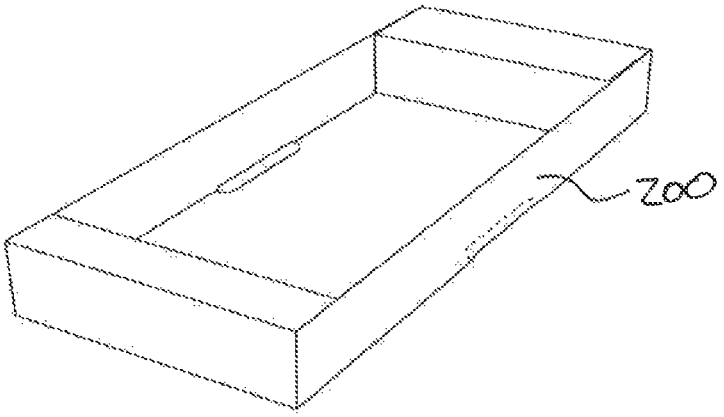
FIGS. 15A to 15D illustrate stages in assembling the package of FIG. 1 from the components of FIG. 3.

Referring to FIG. 15A, the support 200 is first provided. The support may be provided by folding a blank on site to form the desired support configuration.

Alternatively the support may pre-fabricated off-site, by folding a blank or by another method, such as a moulding process that results in a moulded support component.

Figure 15B:
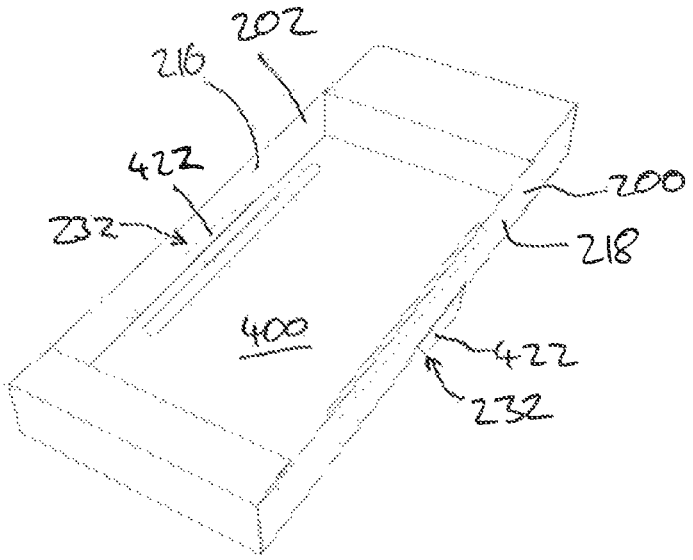

Referring to FIG. 15B, the tab member 400 is then coupled to the support 200.

In this case, the tab member 400 is inserted into the tray 202 of the support 200 so that the tab member 400 defines the base of the tray 202 and the latch formations 422 of the tab member 400 protrude through the apertures 232 of the support 200. The tab member may additionally be adhered to the base of the tray 202 if required.

As the tab member 400 is inserted into the tray, the side walls 216, 218 of the tray 202 exert a force on the latch formations 422 in the unlatching direction to move the latch formations 422 into the disengaged state during insertion. Once the tab member 400 reaches the base of the tray, the latch formations 422 align with the apertures 232 and the latch formations 422 are free to spring outwardly into the engaged position in a snap fit.

Figure 15C:
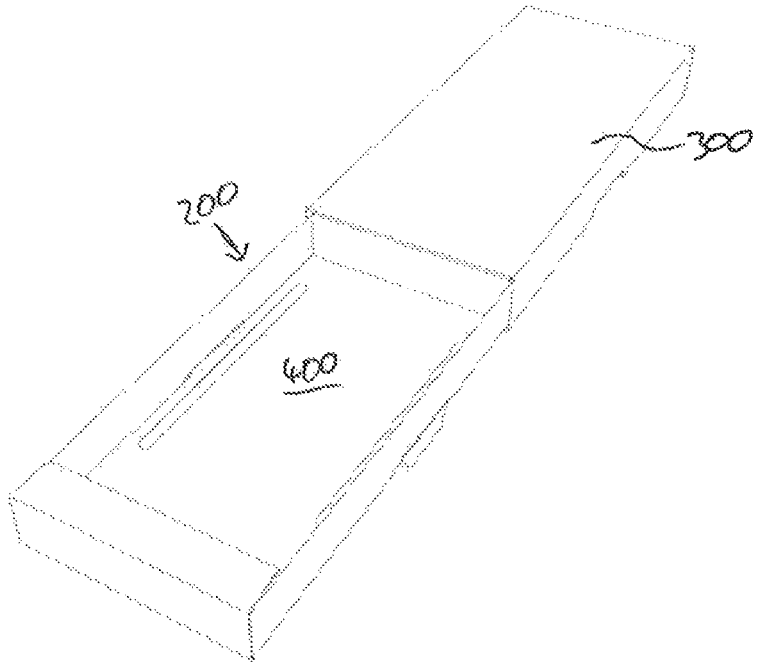

Next, as shown in FIG. 15C, the support 200 and tab member 400 are inserted into the sleeve. To insert the support 200, the rear end of the support 200 is pushed into the open end at the front of the sleeve 300 in a closing direction Y that is opposite to the opening direction X.

Figure 15D:
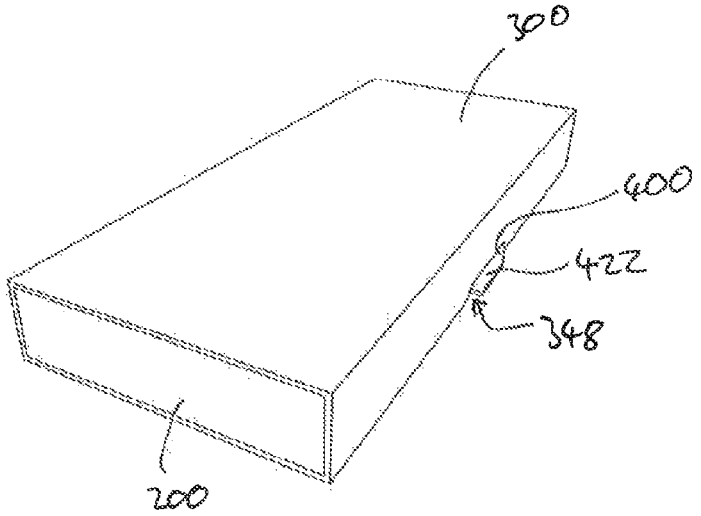

The support 200 and tab member 400 are pushed further into the sleeve 300 until the support 200 reaches the secure position, as shown in FIG. 15D. Once the support 200 reaches the secure position, the latch formations 422 snap fit into the apertures 348 in the sleeve 300 and the assembly process is complete.

In this way, a child resistant package can be simply and easily manufactured by inserting a latchable insert in the form of a planar tab member 400 into a support 200. To confer child-resistant functionality, it is necessary only to couple the latchable insert to the support, in this case by inserting the latchable insert 400 into the support, and thus only one additional process step is required to assemble the package.

A particular advantage of the use of the latchable insert 400 to confer child resistance is that the process is easily scalable. A small run of such packages can be easily achieved with relatively little investment, since the only additional part required is the latchable insert 400 which can be bought on a small scale if necessary. Cardboard blanks making up the sleeve 300 and the support 200 need only be modified by addition of apertures, and this modification can be easily made when the blank is cut or stamped. In this way, a package manufacturer can easily make small runs of the latchable package, for example for testing purposes, economically and without significant investment. Conversely, the process can be easily scaled up to a large-volume output if required.

Furthermore, the planar nature of the tab member means that the tab member can be accommodated in the tray 202 of the support 200 whilst taking up very little space that would be otherwise available for holding items in the tray. In this way, the child resistant functionality has a negligible impact on the size and capacity of the package.

It will be appreciated that the feature of the latchable insert 400, and the features of the access opening and channel may be used independently of one another.

For example, the access opening and channel may be omitted to provide a package with a latchable insert that is intended to be opened in a two-handed operation.

Alternatively, the latchable insert may be omitted and the latch formations, and hence the child-resistant functionality may be integrated directly with the support.

Alternative embodiments, in which the child-resistant functionality is integrated with the support rather than provided by means of a separate latchable insert, will now be described with reference to FIGS. 16 to 19.

Figure 16:
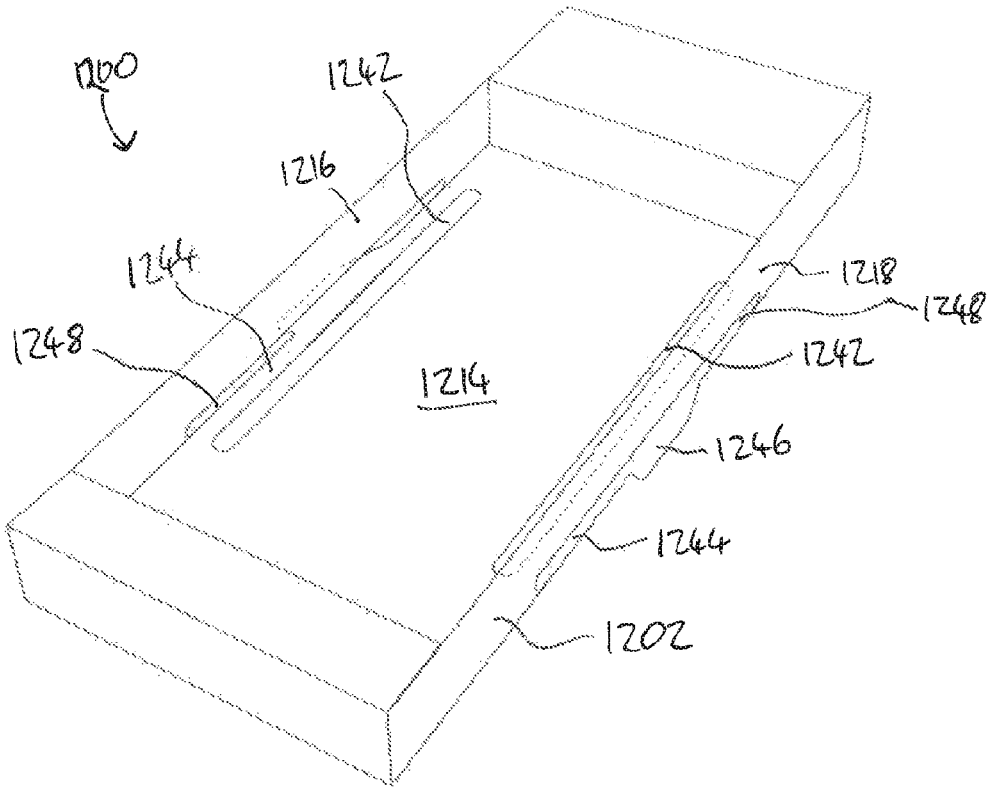
FIG. 16 is a perspective view of a support arrangement according to another embodiment for use in a latchable package.
Figure 17:
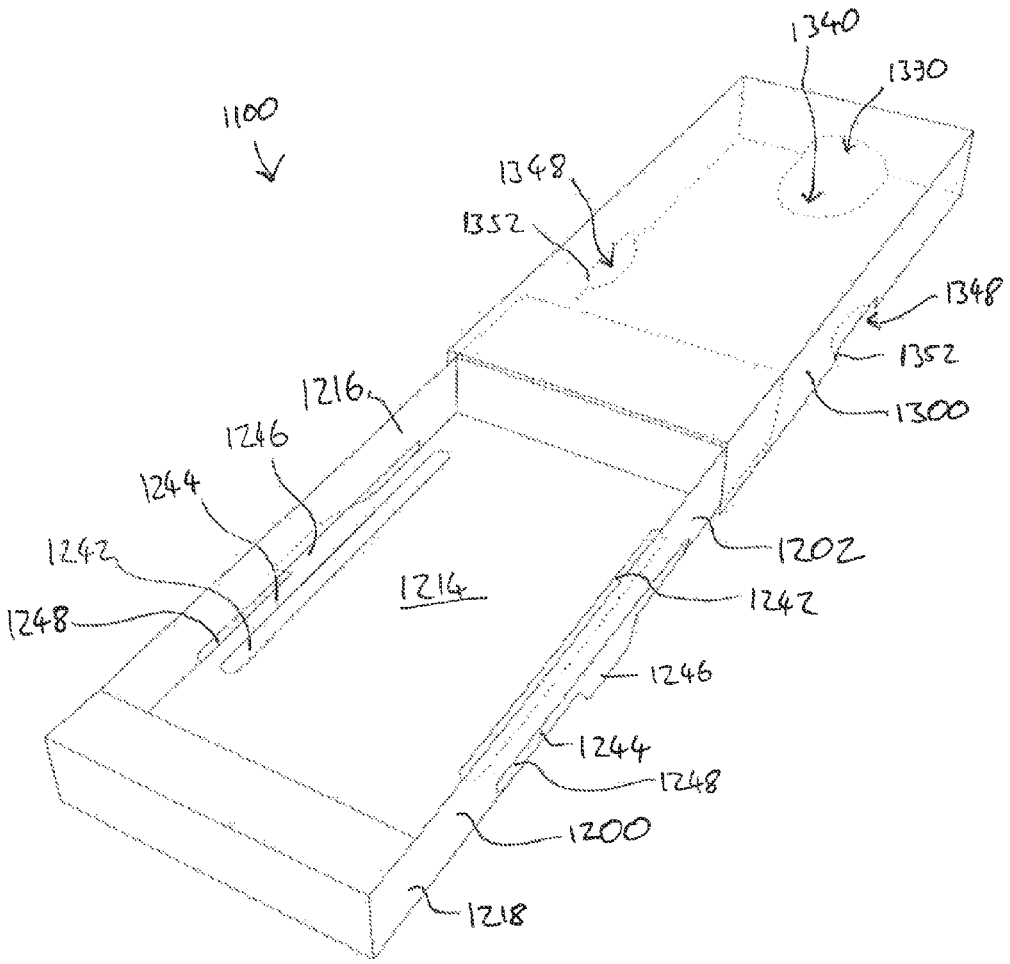
FIG. 17 is a perspective view of a latchable package comprising the support arrangement of FIG. 16.

FIGS. 16 and 17 illustrate a first alternative embodiment of a package 1100. The package comprises a support arrangement 1200 (shown in isolation in FIG. 16) and a structure in the form of a sleeve 1300.

The sleeve 1300 is substantially the same as the sleeve 300 already described above.

The support arrangement 1200 is similar to the support 200 described above but differs in that the support arrangement 1200 has integrated child-resistant functionality.

In particular, the base wall 1214 of the tray 1202 adopts a structure that matches the structure of the tab member described above. In this way, elongate cut outs 1242, latch members 1244, and latch formations 1246 are provided on the base wall 1214 of the tray 1202. The latch formations 1246 protrude beyond side walls 1216, 1218 of the tray 1202 so that the latch formations 1246 can protrude into the apertures 1348 on the sleeve 130 and abut against abutment surface 1352 on the wall surrounding the aperture 1348. The latch formations 1246 of the base wall 1214 operate in substantially the same way as the latch formations 422 of the tab member 400 described above.

In the vicinity of the latch formations 1246, the side walls 1216, 1218 of the tray 1202 are provided with elongate apertures 1248 towards the base of the side walls 1216, 1218. These elongate apertures 1248 sever the latch members 1244 from the side walls 1216, 128, allowing the latch members 1244 to have the flexibility required to move the latch members in the unlatching direction.

Operation of the package is substantially the same as described above. In particular, the latch formations 1246 act together with the access opening 1330 and channel 1340 to provide the combination of child resistance and one-handed operation described in relation to the package 100 above.

The tray 1202 of this embodiment is formed of a plastics material, for example by injection moulding.

Figure 18:
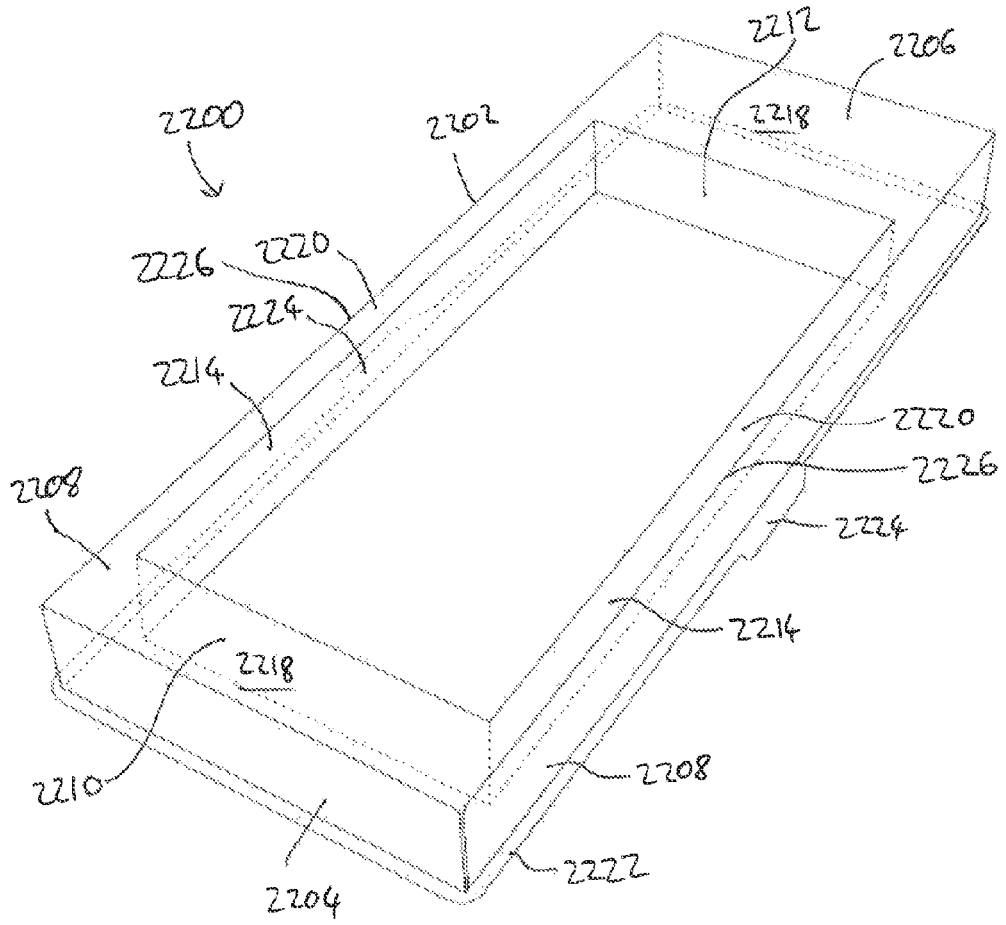
FIG. 18 is a perspective view of a support arrangement according to a further embodiment for use in a latchable package.
Figure 19:
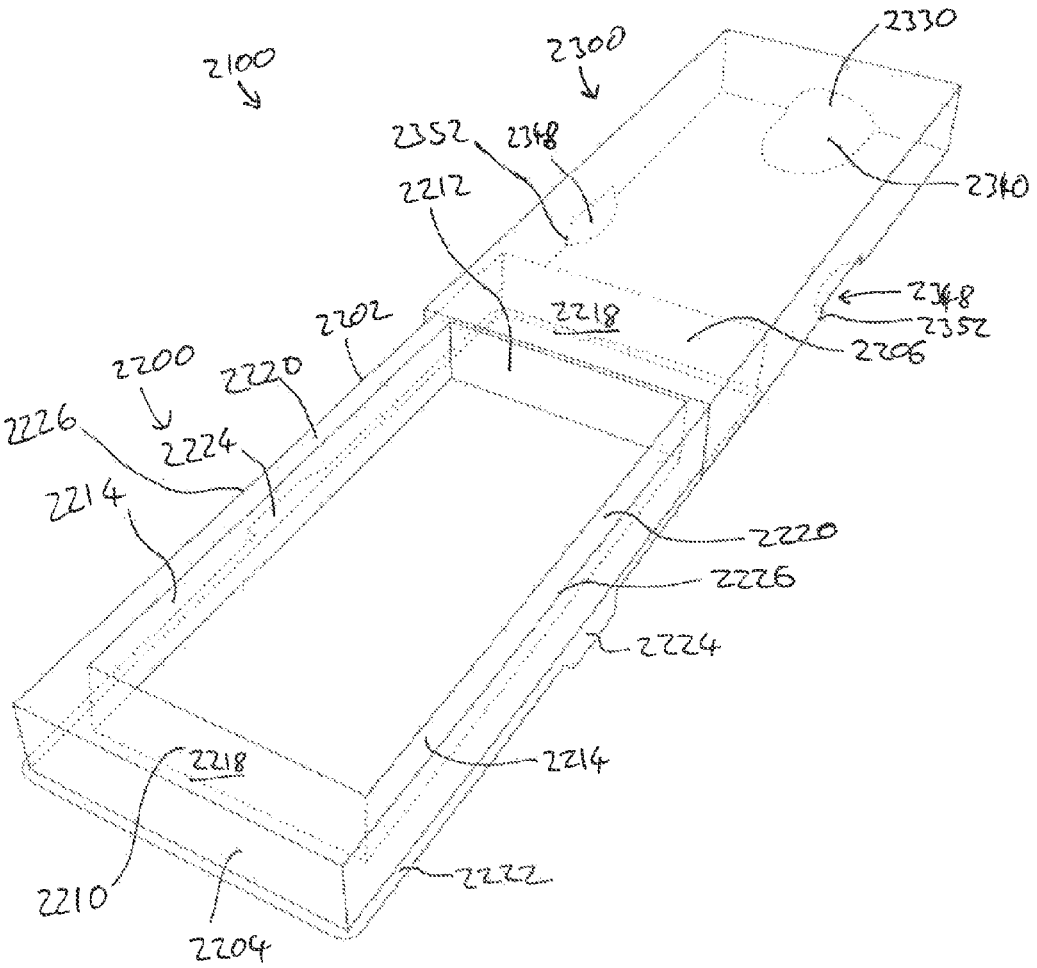
FIG. 19 is a perspective view of a latchable package comprising the support arrangement of FIG. 18.

FIGS. 18 and 19 illustrate a second alternative embodiment of a package 2100. The package comprises a support arrangement 2200 (shown in isolation in FIG. 18) and a structure in the form of a sleeve 2300.

The sleeve 2300 is substantially the same as the sleeve 300 already described above.

The support arrangement 2200 is similar to the support 200 described above but differs in that the support arrangement 2200 has integrated child-resistant functionality.

In this case, the support arrangement 2200 comprises a main body in the form of a shell 2202 that is substantially tray-shaped. The shell 2202 is formed of a plastics material by vacuum moulding. The tray comprises outer front and rear walls 2204, 2206 joined by outer side walls 2208 that define an external perimeter of the tray 2202, and internal front and rear walls 2210, 2212 joined by internal side walls 2214 that define an internal perimeter of the tray 2202. A base wall 2216 joins the internal walls 2210, 2212, 2214 at their base.

At the top surface of the tray 2202, the outer front wall 2204 and outer rear wall 2206 are joined respectively to the inner front wall 2210 and the inner rear wall 2212 by blocking surfaces 2218 which perform the same function as the blocking surfaces described in relation to the package of FIGS. 1 to 15 above. Also at the top surface, the outer side walls 2208 are joined to the inner side walls 2214 by side portions 2220 of the top surface.

Around the outer perimeter of the shell 2202 is a rim 2222 that extends perpendicularly and outwardly in all directions from the outer walls 2204, 2206, 2208. At each of the left and right sides, the rim 2222 is provided with a latch formation 2224 that is of substantially the same shape as the latch formation described in relation to the package of FIGS. 1 to 15 above.

The outer walls 2204, 2206, 2208 of the shell are flexible, by virtue of being thin (typically less than 0.5 mm) and being made of a flexible plastics material. In this way, the left and right side walls 2208 together with the associated rim 2222 and latch formations 2224, define a resiliently deformable latch member. In particular, the join between the side wall 2208 and the side portion 2220 of the top surface acts as a live hinge 2226. Pushing the latch formations 2224 in the unlatching direction L causes the side walls to hinge about these live hinges 2226 so that the latch formations move inwardly from the latched configuration to an unlatched configuration.

In the assembled package 2100, the support arrangement 2200 is housed inside the sleeve 2300. When the support arrangement 2200 is in the secured position, the latch formations 2224 protrude through apertures 2348 on the sleeve 2300 and abut against abutment edges 2352 on the wall surrounding the aperture 2348 in the manner already described above.

Operation of the package is substantially the same as described above. In particular, the latch formations 2246 act together with the access opening 2330 and channel 2340 to provide the combination of child resistance and one-handed operation described in relation to the package 100 above.

Figure 20:
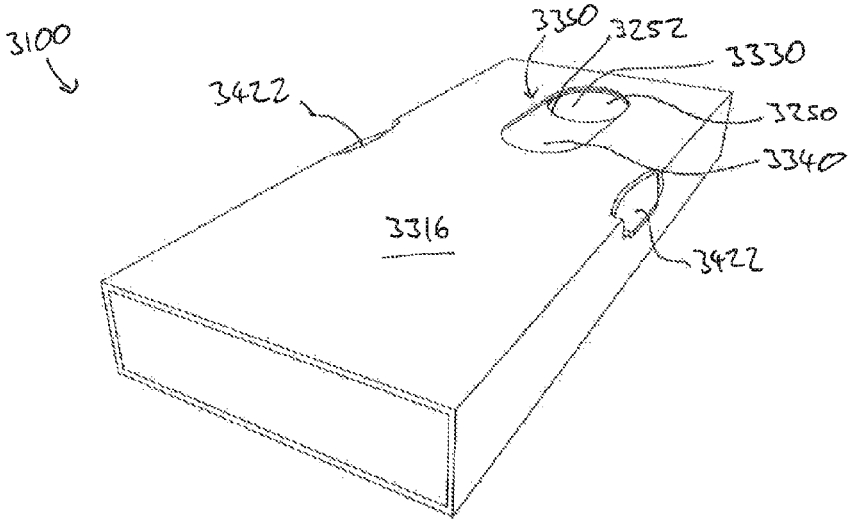
FIG. 20 is a perspective view from below of a package according to another embodiment with the package in a closed configuration.
Figure 21:
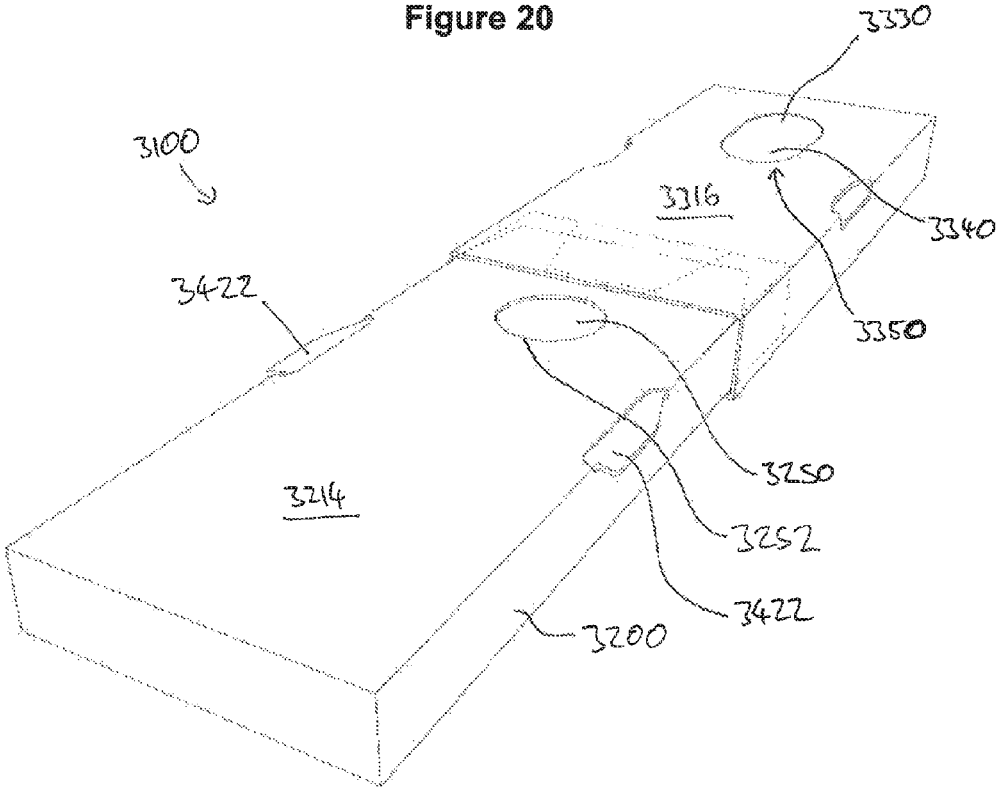
FIG. 21 is a perspective view from below of the package of FIG. 20 with the package in the open configuration.

FIGS. 20 and 21 illustrate a further embodiment of a package 3100. The embodiment of FIGS. 20 and 21 is similar to the embodiment of FIGS. 1 to 15 and differs only in that the access opening 3330 and the channel 3340 are arranged differently.

In this embodiment, the access opening 3330 is provided in the base wall 3316 of the structure 3300. The base wall 3214 of the support 3200 is provided with a grip feature in the form of an aperture 3250, and when the package 3100 is secured as shown in FIG. 20, the aperture 3250 in the base wall 3214 of the support 3200 aligns with the access opening 3330 in the base wall 3316 of the structure 3300. The aperture 3250 in the base wall 3214 of the support 3200 is surrounded by an edge surface 3352.

The channel 3340 is also provided in the base wall 3316 of the structure. The channel 3340 is contiguous with the access opening 3330, such that the access opening 3330 and the channel 3340 are defined by the same cut-out 3350. The channel 3340 extends from the access opening 3300 in the opening direction.

To open the package, a user squeezes the latch formations 3422 in the manner already described in relation to the package of FIGS. 1 to 15. The user then pushes the support by inserting a finger, for example a forefinger, through the access opening 3330 in the structure 3300 and into the aperture 3250 in the support 3200. The user then pushes their forefinger against the edge 3252 of the base wall 3214 surrounding the aperture 3250 to move the support 3200 in the opening direction. The user continues to push the support 3200, whereupon the user's forefinger enters the channel, and follows the channel in the opening direction while continuing to push the support 3200. When the user's finger reaches the end of the channel 3340 the package has been at least partially opened.

The aperture 3250 in the support 3200 could be replaced with an alternative grip feature such as a protrusion or button, which may have a high-friction surface. In this case, the protrusion is accommodated in the channel as the support 3200 is moved in the opening direction.

FIG. 22, FIG. 23 and FIGS. 24*a* to 24*c* illustrate alternative tab members that may be incorporated into a package of the invention in place of the tab members described above.

Figure 22:
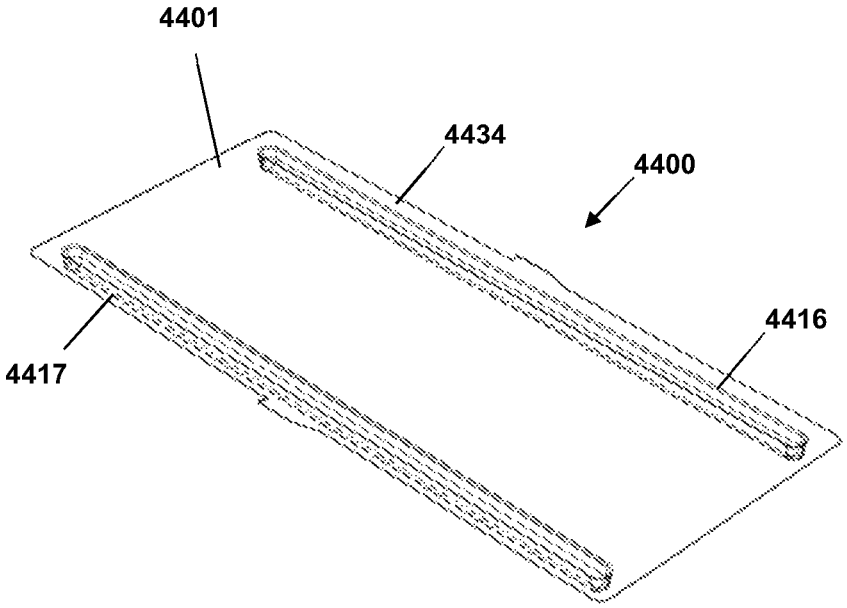
FIGS. 22, 23 and 24*a* are perspective views of alternative tab members that may be used in conjunction with the package of FIG. 1, and FIGS. 24*b* and 24*c* are front views of the tab member of FIG. 24*a* when in operation.

In the tab member 4400 of FIG. 22, the region of low resistance that defines each latch member 4434 is defined by a longitudinal channel 4416 formed in the body 4401 of the tab member 4400 adjacent to the latch member 4434. The channel 4416 is defined by a fold in the body 4401 of the tab member 4400, with the fold protruding out of the plane of the tab member 4400 in a direction that, in use, extends into the support.

When a user squeezes the latch members 4434 between thumb and forefinger, sides of the channels 4416 are squeezed together, thereby allowing the latch members 4434 to move in the unlatching direction.

By virtue of the fold construction, on a side of the tab member 4400 that is opposite to the channel, each fold defines a protrusion or ridge 4417. The ridges 4417 act to increase the bending stiffness of the tab member 4400 and thereby improve its durability.

It will be appreciated that the tab member 4400 could be inverted, in which case the channels 4416 would be similarly inverted to define an inverted channel or a ridge.

Figure 23:
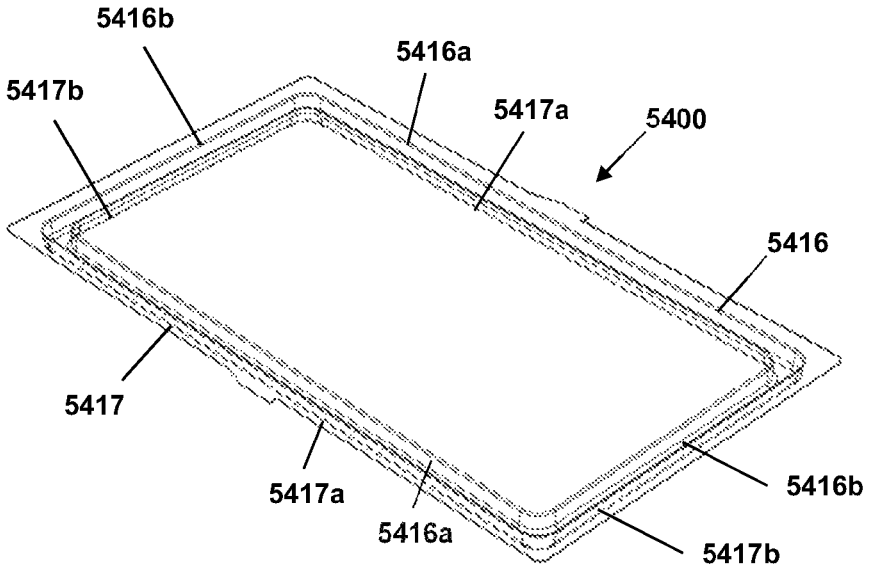

The tab member 5400 of FIG. 23 comprises a channel 5416 that extends around a perimeter of the tab member 5400, slightly inboard from its edges. The channel 5416 comprises left and right longitudinal sections 5416*a* and front and rear transverse sections 5416*b* that join the longitudinal sections 5416*a*.

As with the embodiment of FIG. 22, an underside of the channel 5416 defines a ridge 5417. Undersides of the longitudinal channel sections 5416*a* define longitudinal ridge sections 5417*a* that increase bending stiffness as in the tab member 4400 of FIG. 22. Undersides of the transverse channel sections 5416*b* define transverse ridge sections 5417*b* that provide additional torsional stiffness to the tab member 5400.

As with the embodiment of FIG. 22, it will be appreciated that the tab member 5400 could be inverted, in which case the channels 5416 would be similarly inverted to define an inverted channel or a ridge.

Figure 24A:
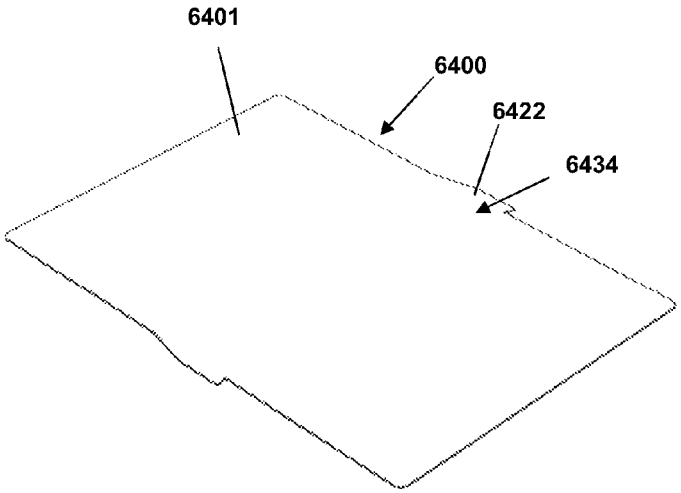

The tab member 6400 of FIG. 24*a* does not comprise a region of low resistance. Instead, the latch member 6434 is integral with the body 6401 of the tab member 6400. In this embodiment, the body of the tab member 6401 is sufficiently flexible that the tab member 6401 can bend out-of-plane.

Figure 24B:
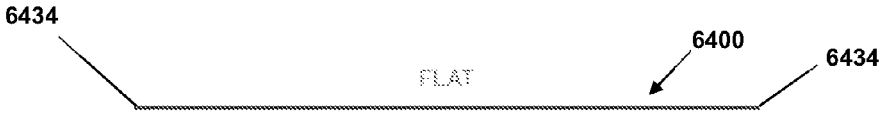
Figure 24C:
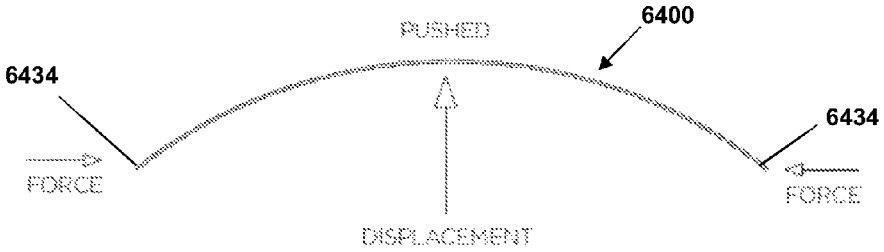

When the latch formations 6422 are in the engaged state, the tab member 6400 is substantially planar as shown in FIG. 24*b*. To move the latch formations 6422 in the unlatching direction and into a disengaged state, a user squeezes the latch members 6434 between thumb and fore finger, and the inward force causes the body 6401 of the tab member 6400 to deflect out of the plane of the tab member 6400 into an arc. The deflection causes the latch formations 6422 to move inwardly towards one another in the unlatching direction.

Figure 25A:
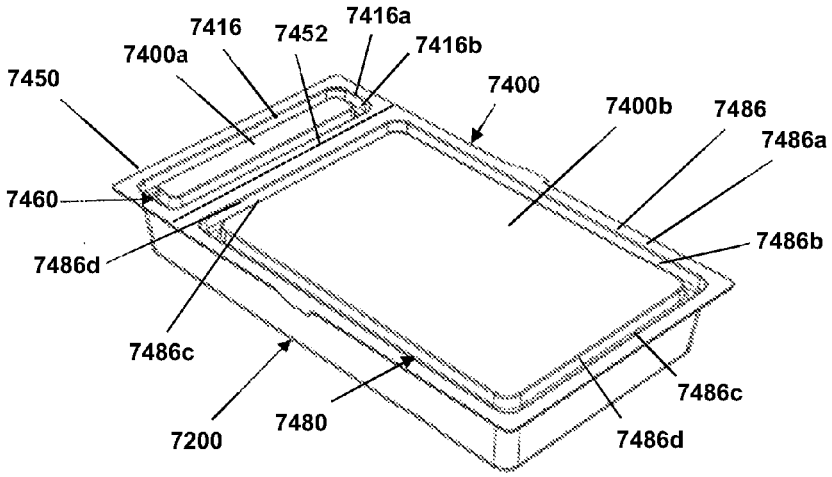
FIGS. 25*a* and 25*b* are perspective views of a support arrangement for use in another embodiment of a package according to the invention, with a planar tab member defining a lid of the container, and showing the lid in the closed and open positions respectively.
Figure 25B:
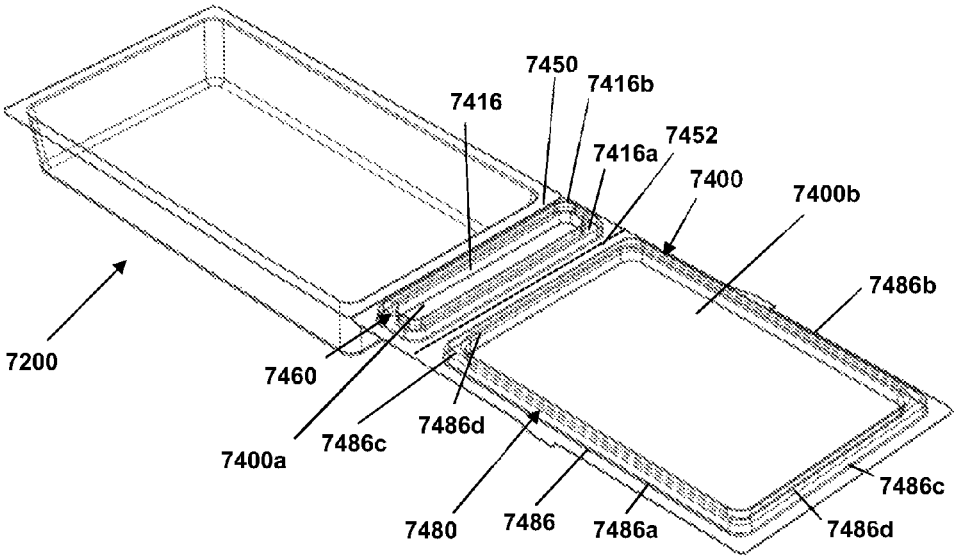
Figure 25C:
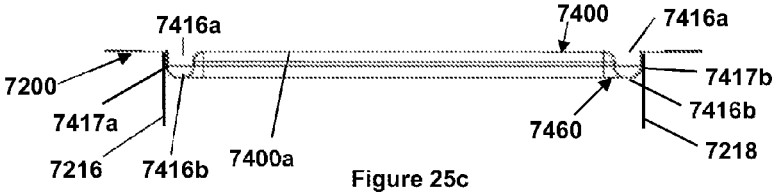
FIGS. 25*c* and 25*d* are cross sections of the planar tab member of FIGS. 25*a* and 25*b* fitted between side walls of a support through the root portions and lid portions respectively, with the lid in the closed position.

FIGS. 25*a* to 25*c* illustrate an alternative tab member 7400 coupled to a support 7200.

The tab member 7400 is optionally hingedly coupled to the support 7200 via a hinge coupling 7450. In the embodiment shown, the support 7200 and tab member 7400 are integrally formed, for example from a thermo-formed sheet or an injection-moulded sheet, and the hinge 7450 is defined by a crease or fold.

Embodiments are also envisaged in which the support 7200 and tab member 7400 are formed from separate pieces and the hinged coupling is omitted.

The tab member 7400 comprises two portions: a root portion 7400*a* and a lid portion 7400*b*. The root portion 7400*a* is coupled to the support 7200 via a coupling means 7460 that will be described in detail later. The root portion 7400*a* is hingedly connected to the lid portion 7400*b* via a hinge 7452 defined by a crease, fold, score or perforation at the boundary between the sections. In this way, the lid portion 7400*a* is movable with respect to the root portion 7400*b* and hence the support 7200 between a closed configuration in which the lid portion 7400*a* blocks access to the support 7200, and an open configuration in which access to the support 7200 is permitted. The lid portion 7400*b* can be retained in the closed position by a retaining means 7480 that will be described in detail later.

The coupling means 7460 that couples root portion 7400*a* to the support 7200 will now be described in further detail, with reference to FIG. 25*c*.

As can be seen in FIG. 25*a*, the coupling means 7460 comprises a channel 7416 that extends around a perimeter of the root portion 7400*a*. The channel 7416 comprises left and right longitudinal channel portions 7416*a* that extend in the opening direction of the package. Undersides of the channels 7416*a* define ridges 7416*b*.

As shown in FIG. 25*c*, when the root portion 7400*a* is coupled to the support 7200, the ridges 7416*b*, sit between side walls 7216, 7218 of the support 7200. More particularly, a spacing between a left-most or outer side wall 7417*a* of the left protrusion, and a right-most or outer sidewall 7417*b* of the right protrusion is substantially the same as a spacing between the side walls 7216, 7218 of the support. In this way, the ridges fit snugly between the side walls 7216, 7218 in a push fit to couple the tab member 7400 to the support 7200.

Figure 25D:
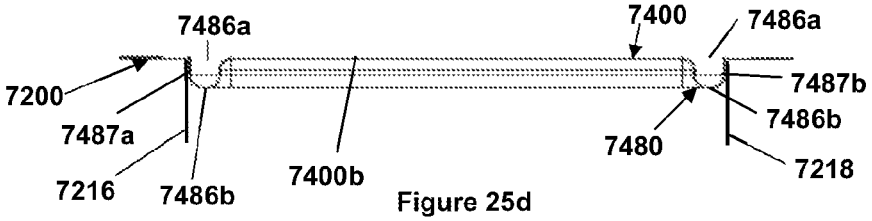

Referring to FIG. 25*d*, the retaining means 7480 of the lid portion 7400*b* that retains the lid portion 7400*b* in the closed configuration is of substantially the same construction as the coupling means 7460 that couples root portion 7400*a* to the support 7200.

In particular, the retaining means 7480 comprises a channel 7486 that extends around a perimeter of the lid portion 7400*b*.

The channel 7486 comprises left and right longitudinal channel portions 7486*a* that extend in the opening direction of the package. Undersides of the channels 7486*a* define ridges 7486*b*.

When the lid portion 7400*b* is in the closed configuration, the ridges 7486*b*, sit between side walls 7216, 7218 of the support 7200. More particularly, a spacing between a left-most or outer side wall 7487*a* of the left ridge, and a right-most or outer sidewall 7487*b* of the right ridge is substantially the same as a spacing between the side walls 7216, 7218 of the support. In this way, the ridges fit snugly between the side walls 7216, 7218 in a push fit to hold the lid portion 7400*b* in the closed position.

The channel 7486 further comprises front and rear transverse channel portions 7486*c* that extend perpendicular to the opening direction of the package. Undersides of the transverse channels 7486*c* define transverse ridges 7486*d*.

When the lid portion 7400*b* is in the closed configuration, the transverse ridges 7486*d* sit between front and rear walls 7212, 7214 of the support 7200. More particularly, a spacing between a front-most or outer wall of the front ridge, and a rear-most or outer wall of the rear ridge is substantially the same as a spacing between the front and rear walls 7212, 7214 of the support. The ridges fit snugly between the front and rear walls 7212, 7214 in a push fit to hold the lid portion 7400*b* in the closed position.

In this way, the lid portion 7400*b* defines a complete seal with the support around its entire perimeter. This is particularly beneficial if the support holds, for example fresh goods, which require an air-tight seal.

Figure 26A:
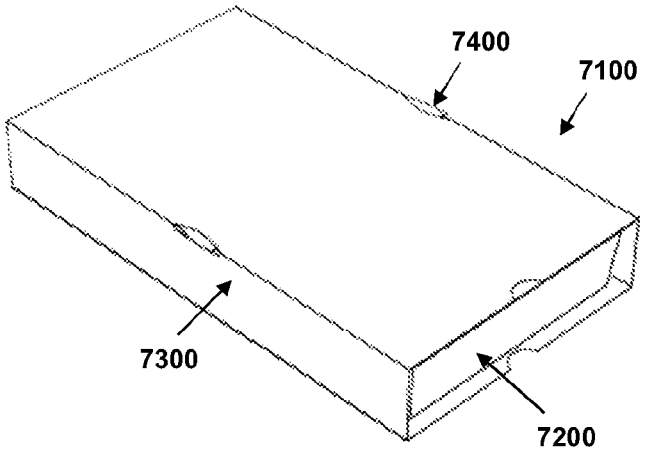
FIGS. 26*a* and 26*b* are perspective views of a package comprising the support arrangement of FIGS. 25*a* to 25*c*, with the package in closed and open positions respectively.
Figure 26B:
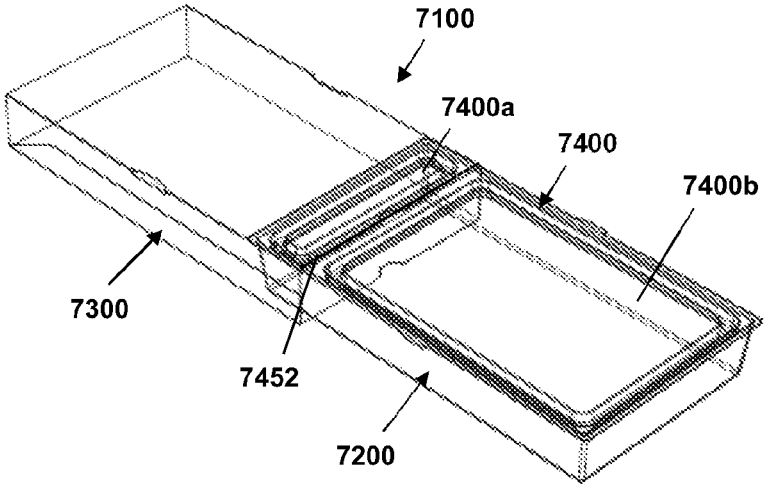

FIGS. 26*a* and 26*b* show the tab member 7400 and support 7200 integrated into a package 7100. As can be seen in FIG. 26*a*, when the package is closed, both the root portion and lid portion are housed within the sleeve 7300 of the package 7100 to prevent access to the support 7200.

As shown in FIG. 26*b*, when the support is moved in the opening direction and the package is brought into the open configuration, the root portion 7400*a* of the tab member remains within the sleeve 7300, while the lid portion 7400*b* is accessibly clear of the sleeve.

More specifically, when the package is in the open configuration, the hinge 7452 between the root portion 7400*a* and the lid portion 7400*b* aligns with an end of the sleeve. In this way, the lid portion 7400*b* can be disengaged from the support 7200, for example by pulling upwardly on the rim of the lid portion 7400*b*, and can be lifted about the hinge 7452 to move the lid portion 7400*b* into an open configuration to access material inside the support.

Figure 27A:
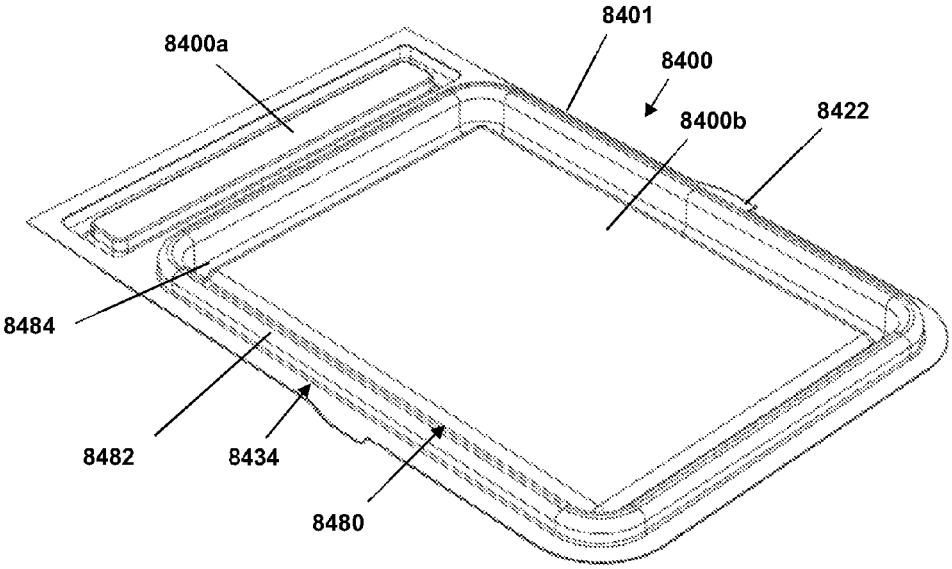
FIGS. 27*a* and 27*b* are perspective and side views respectively of an alternative tab member that can be used with the support arrangement of FIGS. 25*a*, 25*b* and 25*c*.
Figure 27B:
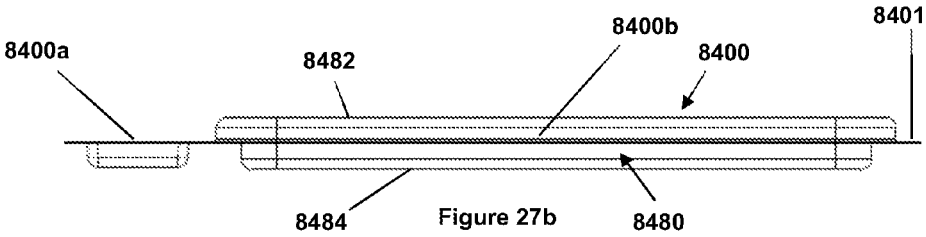
Figure 27C:
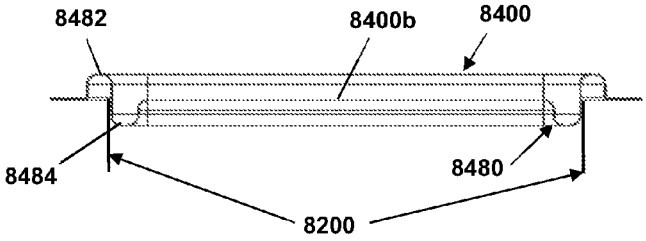
FIG. 27*c* is a front cross-section view of the tab member of FIGS. 27*a* and 27*b* inserted between side walls of the support.

FIGS. 27*a* to 27*c* show an alternative tab member 8400 that is similar to the tab member 7400 of FIG. 26*a*, except that the body of the tab member 8401 comprises an S-shaped fold arrangement that serves to define both a retaining means 8480 and a region of low resistance that defines the latch member 8434.

More particularly, around a perimeter of the root portion 8400*b* of the tab member 8400, the body 8401 of the tab member 8400 is folded into a fold that defines an 'S-shaped' cross section. Moving from an outside edge of the perimeter inwards, the body 8401 is first folded upwardly out of the plane of the tab member in a direction away from the support, and is subsequently folded downwardly out of the plane of the tab member in a direction towards the support.

In this way, if viewed from above, the retaining means 8480 successively defines a ridge 8482 that protrudes away from the support and a channel 8484 that protrudes into the support, the channel and the ridge being adjacent to one another.

The ridge 8482 defined by the upward fold (which it will be appreciated when viewed from below would have the appearance of a channel) provides the region of low resistance that defines the latch member 8434 and facilitates movement of the latch feature 8422 in the unlatching direction, in the same manner as the region of low resistance described in relation to FIGS. 22 and 23 above.

The channel 8484 defined by the downward fold (which it will be appreciated when viewed from below would have the appearance of a ridge), acts as the retaining means that retains the lid portion 8400*b* in the closed configuration in the same manner as the retaining means 7480 described in relation to FIG. 25*d* above, providing a push fit with the support A particular advantage of configuring the tab member 8400 such that the upward fold that defines the region of low resistance is outboard of the downward fold that defines the retaining means, is that the ridge defined by the upward fold can be deformed to effect unlatching of the latch formation without interfering with the position of the downward fold that forms the retaining means, thereby allowing the package to be unlatched without compromising the seal between the lid portion 8400*b* and the support 8200.

Figure 28A:
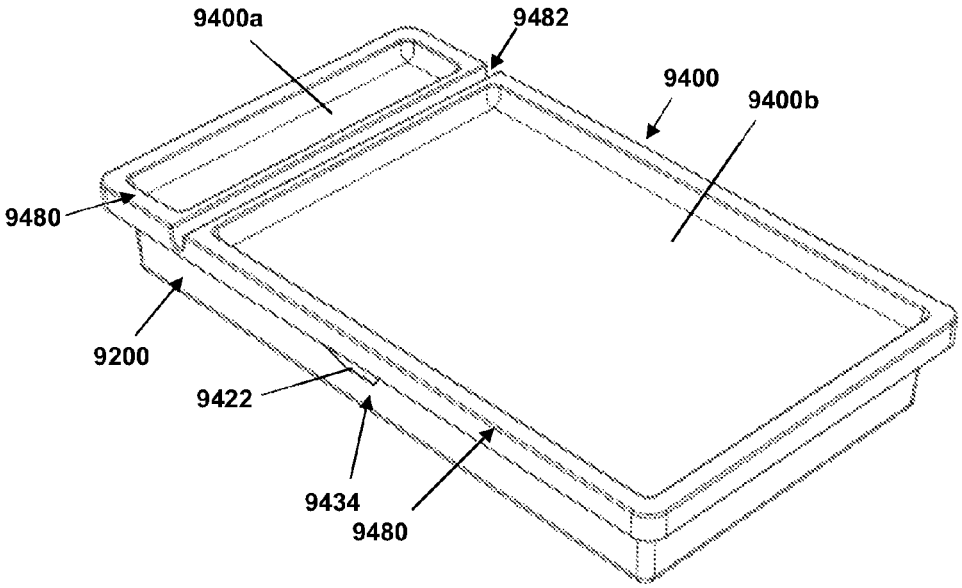
FIGS. 28*a* and 28*b* illustrate a support arrangement for use in a package according to another embodiment of the invention and FIG. 28*c* illustrates the container of FIGS. 28*a* and 28*b* in isolation.
Figure 28B:
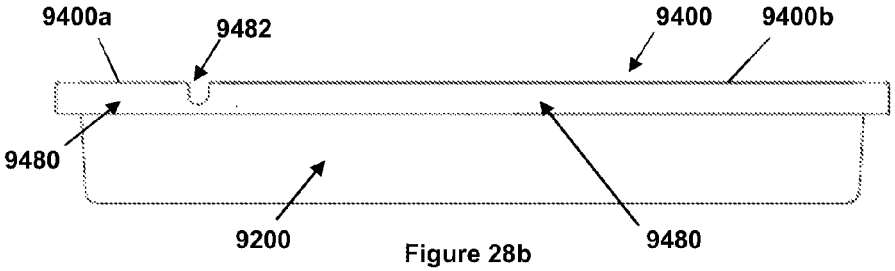

FIGS. 28*a* to 28*b* show a further embodiment of a tab member 9400 for use in the package. The tab member comprises a root portion 9400*a* and a lid portion 9400*b*. Each of the root portion 9400 and lid portion 9400*b* comprise a rim 9480 at the outer edge of the respective portion, the rim 9480 being defined by an upward fold that defines an inverted channel. The fold defines sidewalls of the rim and a top wall that extends between the side walls. Between the rim 9480 of the root portion 9400*a* and the rim 9480 of the lid portion 9400*b* is a channel or groove 9482 that acts as a hinge.

The rims 9480 define a coupling means on the root portion 9400*a* and a retaining means on the lid portion 9400*b*. The rim is configured to sit over the sidewalls and front and rear walls of the support so as to form a seal over the support. In particular, the walls of the support are sized to fit snugly between the inner sidewalls of the rim to define a seal. This acts firstly to couple to root portion 9400*a* to the support 9200, and secondly to retain the lid portion 9400*b* in the closed position with respect to the support 9200.

The fold of the rim 9480 provides the region of low resistance that defines the latch member 9434. The latch formations 9422 are supported on outer side walls of the rim 9480. Squeezing the latch formations 9422 together causes the outer side walls to move together, thereby causing the latch formations 9422 to move in the unlatching direction.

Figure 28C:
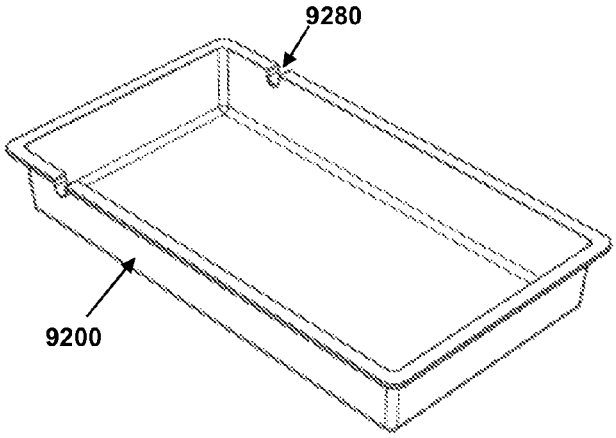

FIG. 28*c* shows the support 9200 in isolation and reveals that the sidewalls of the support comprise a detent 9280 that accommodates the groove or channel 9482 between the root portion 9400*a* and the lid portion 9400*b*. In this way, the tab member 9400 can be pushed over the walls of the support 9200 until the top wall of the rim 9480 of the tab member 9400 contacts the walls of the support 9200, with the groove or channel 9482 of the tab member 9200 being accommodated in the detent 9280 in the support 9200.

Figure 29A:
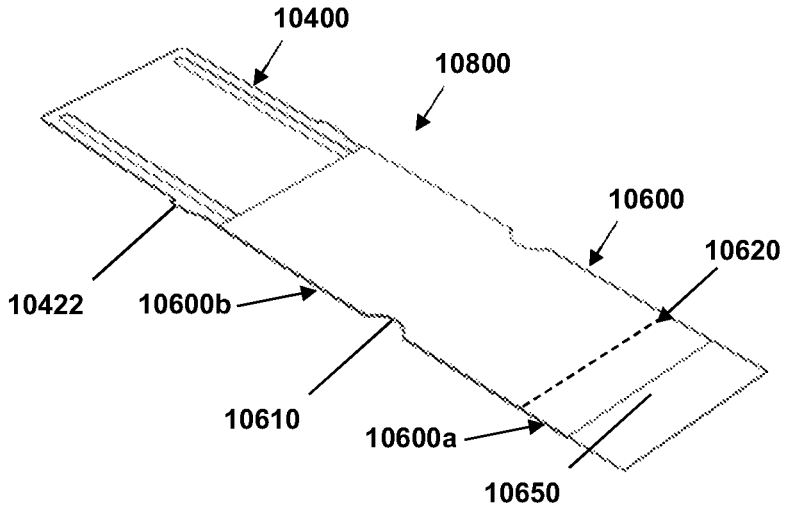
FIGS. 29*a* and 29*b* illustrate a further alternative tab member according to the invention, in which the tab member is housed in a sleeve and the sleeve and tab member together define a lid of the container.
Figure 29B:
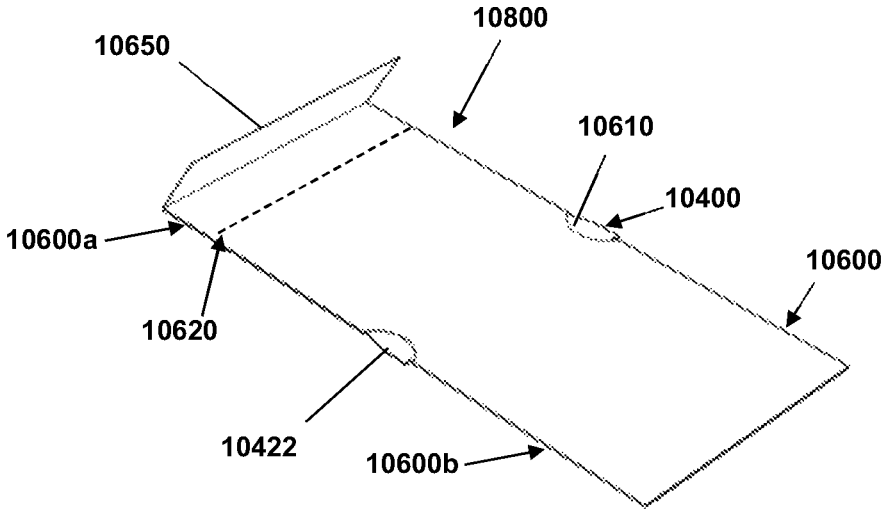

FIGS. 29*a* and 29*b* show an insert arrangement 10800 for use with the support. The insert arrangement comprises an insert defined by a tab member 10400 that is substantially the same as the insert of FIG. 4, and a sleeve 10600 that houses the insert.

The sleeve 10600 is substantially flat and defines a passage that receives the insert 10400. The sleeve 10600 comprises apertures 10610 in its left and right sides, through which the latch formations 10422 of the tab member 10400 protrude.

The sleeve may be made from cardboard and may be printed, for example with information or promotional material.

The sleeve 10600 comprises a root portion 10600*a* and a lid portion 10600*b*, the root portion 10600*a* being coupled to the support and the lid portion 10600*b* being moveable relative to the root portion 10600*a* to move between closed and open configurations. The sleeve comprises a hinge 10620 between the root and lid portions.

Figure 29C:
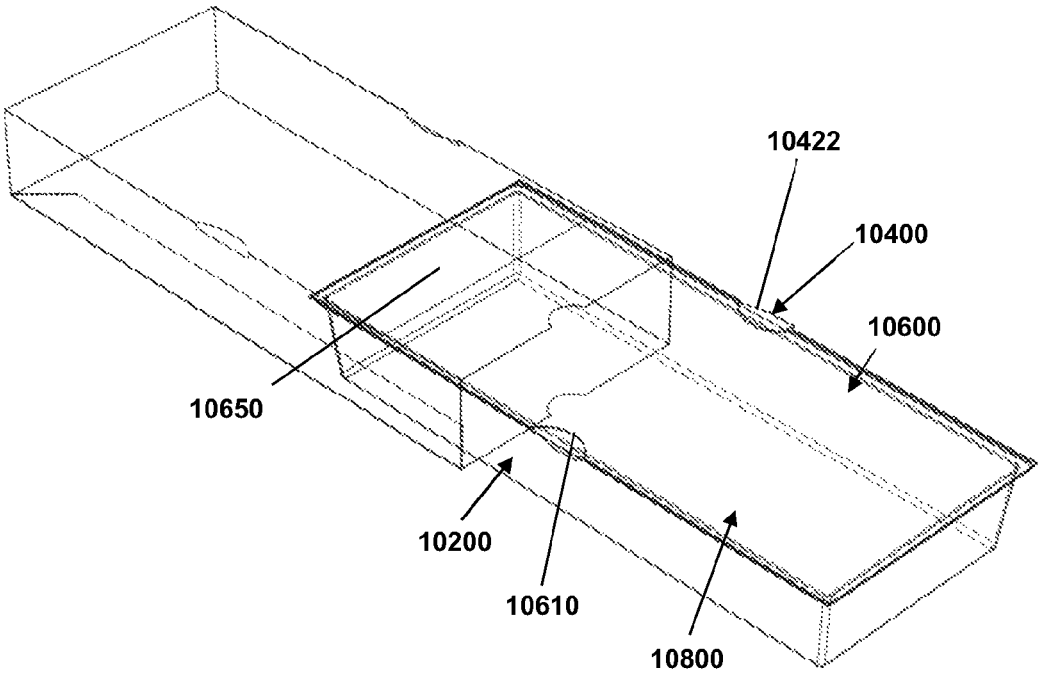
FIG. 29*c* illustrates the tab member in use in a package where the tab member defines a lid of the support.

In use, as shown in FIG. 29*c*, the sleeve 10600 is coupled to the support 10200. The coupling between the sleeve 10600 and the support indirectly couples the tab member 10400 to the support 10200.

At one end, the sleeve 10600 defines a flap 10650 that is hingedly connected to a part of the sleeve 10600 that houses the insert. When integrated into the package, the flap 10650 can act as a stop formation of the type that has already been described above, to limit withdrawal of the support.

It will be appreciated that stop formations in the form of flaps or other suitable constructions can be provided on any of the tab members described above.

In the embodiments shown, the child resistance provided by the latches is augmented by the fact that the spacing between the latch formations is great enough that a child could not easily depress both latch formations simultaneously with one hand. However, this width of the package merely augments the child resistance, and is not a necessary feature. For example, in relatively small packages, the width of the package may not be large enough to augment the child resistance in this manner, and in such small packages the presence of the latches is sufficient to provide ample child resistance.

Although in the embodiments described the package is provided with two latch members and two latch formations, it will be appreciated that in some embodiments only a single latch formation and/or latch member need be provided. In other embodiments, more than two latch formations or latch members may be provided. For example, a single latch member may support more than one latch formation. In another embodiment, each side of the tab member may have two slots that provide two latch members, and each latch member may support one of more latch formations. The latch formations need not be provided at a central position, but may be provided at any suitable location, for example, towards the front or rear end of the package.

In embodiments where a latchable insert is used, the insert need not be placed in the base of the support, but may be in any suitable position. For example, the insert may be arranged above the support such that the insert defines a lid for the tray.

The latchable insert may be coupled to the support by any suitable means that allows movement of the support to effect movement of the insert in the same direction. For example, the insert may be adhered to the support, mechanically attached to the support, or carried by the support to effect the coupling.

It should be appreciated that various other modifications and improvements can be made without departing from the scope of the invention as defined in the claims.

The invention claimed is:

1. A latchable package comprising:

a support for supporting one or more items, a structure for selectively blocking access to the one or more items; and a latchable insert, wherein the latchable insert is a substantially planar tab member that is coupled to the support such that the insert and support are movable together in an opening direction from a first position in which the structure blocks access to the one or more items to a second position in which the one or more items are accessibly clear of the structure;

wherein the structure and the latchable insert comprise co-operating latch features configured to engage when the insert and support are arranged in the first position; and wherein the tab member comprises a body portion and a deformable latch member connected to the body portion by at least one live hinge, the latch member incorporating the latch formation and the latch formation being moveable by a user in an unlatching direction that lies substantially in a plane of the tab member.

2. The latchable package of claim 1, wherein the support comprises a tray.

3. The latchable package of claim 2, wherein the latchable insert defines a cover of the tray that is movable between a closed configuration in which the latchable insert blocks access to the tray, and an open configuration in which the contents of the tray are accessible.

4. The latchable package of claim 3, wherein the latchable insert comprises a retaining formation configured to retain the latchable insert in the closed configuration.

5. The latchable package of claim 4, wherein the tray comprises opposite side walls, and wherein the retaining formation comprises a retaining feature that is configured to fit between side walls of the tray in a push-fit to retain the latchable insert in the closed configuration.

6. The latchable insert of claim 5, wherein the retaining formation comprises a pair of elongate channels that extend parallel to the side walls of the support, the channels extending out of the plane of the tab member to define side walls that fits inside the side wall of the support in a push fit.

7. The latchable package of claim 3, wherein the latchable insert comprises a root portion that is coupled to the support and a lid portion that is movable with respect to the support to move the latchable insert into the open position.

8. The latchable package of claim 7, wherein the insert comprises a hinge between the root portion and the lid portion.

9. The latchable package of claim 7, wherein the root portion comprises a coupling formation configured to couple the root portion to the support.

10. The latchable package of claim 9, wherein the support comprises opposite side walls, and wherein the coupling formation comprises a coupling feature configured to fit between the side walls in a push fit to couple the latchable insert to the support.

11. The latchable package of claim 1, wherein the latch feature of the latchable insert comprises one or more latch formations.

12. The latchable package of claim 11, wherein the latch feature of the structure comprises one or more abutment surfaces against which the one or more latch formations abut to engage to co-operating latch features.

13. The latchable package of claim 12, wherein the abutment surfaces are defined by an aperture on the structure.

14. The latchable package of claim 11, wherein the support comprises a side wall having an aperture through which the or each latch formation of the latchable insert protrudes.

15. The latchable package of claim 1, wherein the deformable latch member is defined by a region of low resistance between the body portion and the latch member.

16. The latchable package of claim 15, wherein the region of low resistance is defined by a cut-out, channel, ridge, fold or detent in the tab member.

17. The latchable package of claim 16, wherein the region of low resistance is defined by an elongate fold in the tab member, the fold defining a ridge or channel that protrudes out of the plane of the tab member.

18. The latchable package of claim 11, wherein the tab member has opposed major faces connected by opposed side edges and the latch formation is moveable by a user in an unlatching direction that is substantially orthogonal to at least one side edge.

19. The latchable package of claim 1, wherein the latch member is connected to the body portion by a pair of live hinges arranged at opposed ends of the latch member.

20. The latchable package of claim 1, wherein coupling between the latchable insert and the support is effected by means of an adhesive.

21. The latchable package of claim 1, wherein coupling between the latchable insert and the support is effected by means of a mechanical coupling.

22. The latchable package of claim 21, wherein the latchable insert is configured to couple to the support by means of a push-fit.

23. The latchable package of claim 1, wherein the latchable package comprises a withdrawal stop structure for limiting movement of the support in the opening direction.

24. A latchable package comprising:

a support for supporting one or more items, a structure for selectively blocking access to the one or more items; and a latchable insert, wherein the latchable insert is a substantially planar tab member that is coupled to the support such that the insert and support are movable together in an opening direction from a first position in which the structure blocks access to the one or more items to a second position in which the one or more items are accessibly clear of the structure;

wherein the structure and the latchable insert comprise co-operating latch features configured to engage when the insert and support are arranged in the first position;

wherein coupling between the latchable insert and the support is effected by means of a mechanical coupling; and wherein the latchable insert is configured to couple to the support by means of a push-fit.

* * * * *